US005918325A

United States Patent [19]

Arita et al.

[11] Patent Number: 5,918,325

[45] Date of Patent: Jul. 6, 1999

[54] FLUSH TOILET BOWL

[75] Inventors: Kinya Arita; Ryouichi Tsukada; Shinji Shibata; Hiroyuki Matsushita, all of Kitakyushu, Japan

[73] Assignee: Toto, Ltd., Fukuoka-Ken, Japan

[21] Appl. No.: 08/860,419

[22] PCT Filed: Dec. 27, 1995

[86] PCT No.: PCT/JP95/02722

§ 371 Date: Jun. 24, 1997

§ 102(e) Date: Jun. 24, 1997

[87] PCT Pub. No.: WO96/20316

PCT Pub. Date: Jul. 4, 1996

[30] Foreign Application Priority Data

| | | | |
|---|---|---|---|
| Dec. 28, 1994 | [JP] | Japan | 6-328664 |
| Apr. 11, 1995 | [JP] | Japan | 7-85780 |
| Jun. 19, 1995 | [JP] | Japan | 7-151882 |

[51] Int. Cl.[6] ..... E03D 11/00

[52] U.S. Cl. ..... 4/420; 4/424; 4/428

[58] Field of Search ..... 4/420, 421, 424, 4/425, 428, DIG. 13

[56] References Cited

U.S. PATENT DOCUMENTS

| | | | |
|---|---|---|---|
| 1,964,876 | 7/1934 | Gavin | 4/425 |
| 2,129,398 | 9/1938 | Beam | 4/425 |
| 3,086,217 | 4/1963 | Barlow | 4/425 |
| 3,484,873 | 12/1969 | Hoard et al. | 4/428 |
| 4,197,599 | 4/1980 | Tsai | 4/420 |
| 5,142,712 | 9/1992 | Hennessy . | |
| 5,204,999 | 4/1993 | Makita et al. | 4/425 |

FOREIGN PATENT DOCUMENTS

| | | |
|---|---|---|
| A58245381 | 8/1956 | Japan . |
| 64-75740 | 3/1989 | Japan . |

*Primary Examiner*—David J. Walczak

*Attorney, Agent, or Firm*—Birch, Stewart, Kolasch & Birch, LLP

[57] ABSTRACT

A flush toilet bowl comprises a bowl part (1) and a discharge trap (2) formed continuously at the bottom of the bowl part. The discharge trap (2) further comprises a rising channel (22) extending in the obliquely upward direction from the bottom of the bowl part, a first weir (27) formed at the upper end of the rising channel, a descending channel (23) extending downwardly from the first weir, and a cross-laid channel (24) extending substantially in the horizontal direction from the lower end of the descending channel and having a discharge opening (25) at the end. The cross-laid channel (24) is provided with an upwardly bent second weir (28) between the lower end of the descending channel and the discharge opening, and a gathered water part (29) is formed between the second weir (28) and the lower end of the descending channel. The descending channel is formed in the vicinity of the lower end thereof with a horizontal part (26) extending horizontally toward the cross-laid channel (24).

19 Claims, 22 Drawing Sheets

| VALUATION | VERY GOOD | POOR | GOOD |
|---|---|---|---|

FLUSH TOILET BOWL

BACKGROUND OF THE INVENTION

1. Technical Field

This invention relates to a flush toilet bowl and, more particularly, a flush toilet bowl of a type which discharges sewage by a syphoning action.

2. Background Art

In regard to such a type of flush toilet bowl, a wide variety of constructions have hitherto been known, a typical one being described in JP-U Sho-58-25381. The flush toilet bowl described in this publication is called the syphon jet type. The water discharge trap of the toilet bowl has a stepped part in a descending path and is transversely bent substantially at a right angle on the downstream side of the stepped part. Thereafter, a discharge opening opens vertically (hereinafter, such a discharge trap is referred to as a cross-laid type trap).

In this type of flush toilet bowl, the stepped part provided in the descending channel of the discharge trap causes a disturbance of water flow and forms the wall of water (seal), thereby producing a syphoning action. Hereupon, a principle of syphoning action will be explained. At the stage before flushing, the interior of the discharge trap is under an atmospheric pressure which is the same as that on the surface of the gathered water. The supplying of flushing water to this place causes the disturbance of water flow due to the stepped part, thereby forming a wall of water (seal) which closes one end of the trap.

When the supply of water continues in a condition of the seal being formed, air within the trap is discharged together with water and the pressure within the trap becomes negative with respect to the atmospheric pressure. This negative pressure causes a drawing force. As the discharge of air further proceeds, the trap is substantially filled with water and, at this time, the maximum drawing force occurs. Namely, a phenomenon of syphoning is produced by the initial seal, grows by the discharge of air and puts forth the maximum drawing force when the trap is filled with water. So, realizing the rapid production and growth of the syphoning action is important in order to save the amount of the flushing water.

Particularly, in the case where the position of the flush tank in the flush toilet bowl is attempted to be lowered for low-silhouetting the bowl, the potential energy of flushing water naturally becomes smaller, and so, in order to save an amount of flushing water, the realization of the above-described rapid production and growth of the syphon is all the more important. Moreover, ensuring a high capacity of water discharge is required.

Now, as a toilet bowl having a construction of air within the discharge trap being discharged early in order to ensure the early production of the syphon, there is one such type disclosed in U.S. Pat. No. 5,142,712.

This toilet bowl is provided with a cross-laid type discharge trap in a similar way to the toilet bowl disclosed in the above-described JP-U 58-25381. The cross-laid channel is bent upwardly before the discharge opening to provide a gathered water part before the discharge opening, in which a seal part is constituted. The air existing between the sealed water part and the above-described gathered water part is drawn under a negative pressure produced within the sealed tank by the discharge of the water within the sealed tank, so that the air within the trap is discharged, thereby ensuring the early production of the syphoning action. In this connection, the reason why a ventilation room is provided in the gathered water part in such a toilet bowl, is that there occurs the following disadvantage: If there is no ventilation room, because of the seal being always constituted at two points, a phenomenon of syphoning occurs in a considerably easy way. For example, in the case where a negative pressure occurs in the discharge pipe, such a negative pressure sucks and discharges not only the water in the gathered water part, but also the sealed water per se in the toilet bowl, so that odor from the discharge pipe reversely flows into the chamber by way of the bowl part of the toilet bowl.

However, the toilet bowl described in said U.S. Pat. No. 5,142,712 requires a sealed tank construction because of the utilization of the negative pressure within the tank. Further, connection of the downstream of the sealed water part to the interior of the tank produces the possibility of odor flowing into the tank, and so a separate construction for preventing such a possibility is required.

Accordingly, as to the construction of a toilet bowl, it is considered that the toilet bowl disclosed in U.S. Pat. No. 5,142,712 is conventionally used in combination with an ordinary tank which has no sealed construction and has only a function of gathering and discharging water; however, there occur problems as described below.

Since the sealed part is constituted only by the gathered water part, a large amount of water is required to close the above-described ventilation room, and it takes much time to produce a syphoning action; consequently, a large amount of flushing water is required. Making this ventilation room narrower is considered, however, there is a problem in that if it is made too narrow, the above-described disadvantages are apt to occur.

Further, an air pool is apt to occur in the inner portion of the descending channel of the trap and hinders the growth of a syphoning action, so, it is difficult to expect a sufficient effect in terms of the early production of a syphoning action in spite of the adoption of the sealed construction due to the gathered water part.

Moreover, since the weir between the rising channel of the discharge trap and the descending channel of the discharge trap is bent substantially at a right angle, the water which has passed through the weir comes off the weir and collides with the side wall at the back of the descending channel of the trap before it reaches the gathered water part, thereby forming water turbulence which swallows up the air within the trap. Further, it takes much time to discharge the air within the trap.

In addition, there was a problem in that in the cross-laid type of trap, water stream changes from the transverse direction to the vertical direction before the discharge opening in view of its construction; however, a change of direction of the water stream at this portion is not smoothly performed and a force of water discharge from the discharge opening is reduced.

Further, it is empirically known that the thinner the diameter of the discharge trap is, the earlier the production of the syphoning action is, however, if the diameter of the trap is made too thin, clogging of sewage is apt to occur and the primary function of the toilet bowl is adversely affected. Moreover, a large change in the diameter of the discharge trap causes a large loss of energy. Therefore, when the syphoning action is produced, a force of suction due to the syphoning action does not become great, and an increase in the flushing capacity cannot be expected.

In regard to another type of flush toilet bowl, a low-silhouette type of flush toilet bowl having a flush tank, in which flushing water is stored, disposed in a position lower than the toilet bowl body, is generally regarded as a high grade flush toilet bowl. Such a type of flush toilet bowl in the past includes the one which is described in JP-A Sho-64-75740. The toilet bowl described in this publication is a toilet bowl of a so-called syphon vortex type in which a syphoning action and a vortical action are used in combination. A decrease in the force of water supplied to the tank due to the fact that the position of the top of the flush tank B is lowered, as shown in FIG. 27, to suppress the water level of the flushing water from a rim surface 3*a* of the toilet bowl body A in a lower level, is supplemented in such a way that the flush tank B is positioned lower than the rim surface 3*a* to thereby increase the capacity of the tank to make an amount of water used at the time of flushing larger, thereby ensuring a total amount of discharge of 16 liters or so (total amount discharged from the toilet bowl to the discharge pipe in a single usage).

In the meantime, the requirement of water saving for the flush toilet bowl has gradually come to be a strict one in recent years, particularly, in the U.S.A. it has become strict to such a degree that a regulation limits the total amount of discharge to 1.6 gallons (6 liters). Therefore, it is difficult to save water while ensuring the flushing capacity using the syphon-type toilet bowl having a conventional construction, and it is particularly difficult to cope with such a requirement with the low-silhouette type toilet bowl.

The present invention has been made taking the above-described problems in the prior arts into consideration, and aims at providing a flush toilet bowl which can sufficiently cope with the strict requirements of water saving in recent years and allows a sufficient flushing capacity to be displayed.

SUMMARY OF THE INVENTION

A flush toilet bowl according to the present invention comprises:

a bowl part, and a discharge trap formed continuously at the bottom of said bowl part, said discharge trap including a rising channel extending in the obliquely upward direction from the bottom of the bowl part; a first weir formed at the upper end of said rising channel; a descending channel extending downwardly from said first weir; and a cross-laid channel extending substantially horizontally from the lower end of said descending channel and having a discharge opening at the end thereof, said cross-laid channel being provided with an upwardly bent second weir between the lower end of said descending channel and the discharge opening, and being formed with a gathered water part between said second weir and the lower end of said descending channel, said descending channel being formed in the vicinity of the lower end thereof with a horizontal part extending horizontally toward said cross-laid channel.

Further, a flush toilet bowl according to the present invention comprises:

a toilet bowl body having a bowl part and a discharge trap formed continuously at the bottom of said bowl part;

a flush water tank disposed at the back of said toilet bowl body so that its discharge port is positioned substantially at the same level as the rim surface of the toilet bowl body; and a jet water path which connects the discharge port of said flush water tank to the jet water delivery port provided facing the inlet of said discharge trap, said jet water path having a bent part turning the direction of flow toward the jet water delivery port before the jet water delivery port, and said jet water delivery port being provided in the vicinity thereof with a means for revising a distribution of the velocity of flow, said means performing the revision of a distribution of the velocity of flow so that the velocity of flow substantially in the center of the jet water delivery port becomes the maximum.

Moreover, a flush toilet bowl according to the invention, comprises:

a toilet bowl body having a bowl part and a discharge trap formed continuously at the bottom of said bowl part;

a flush water tank disposed at the back of said closet bowl body so that its discharge port is positioned substantially at the same level as the rim surface of the toilet bowl body; and a jet water path which connects the discharge port of said flush water tank to the jet water delivery port provided facing the inlet of said discharge trap, said jet water path being provided with an air discharging means by which the air within said jet water path is discharged substantially at the same time a discharge of water from the discharge port of said flush water tank is started.

According to the invention, the uneven distribution of the velocity of flow, which occurs at the point where the direction of the flow of flushing water is changed from the descending channel to the cross-laid channel of the discharge trap, is revised by the horizontal part, the production and maintenance of the seal of the discharge trap due to the flushing water are ensured, thereby enabling the realization of the stabilization of the production of a syphoning action and the rapid growth thereof.

Further, according to the invention, since a radius of curvature of the weir between the rising channel and descending channel of the discharge trap is made into a large radius of curvature which amounts to 0.9 to 1.4 times the size of the diameter of the discharge trap, a change of direction as the flow of flushing water changes from the transverse direction to the vertical direction, while flowing from the rising channel to the descending channel of the discharge trap, is made smooth to prevent water from coming off the weir, thereby ensuring a large force of water discharge and, simultaneously, allowing flushing water to be supplied to the gathered water part without any loss, so that the early production and rapid growth of a syphoning action can be realized.

Moreover, according to the invention, after the cross-laid channel is bent upwardly to form the gathered water part, it is formed so as to continue from its bent part to the discharge opening. Further, the downward portion of the bent part has a large radius of curvature of 0.7 to 1.2 times the size of the diameter of the trap. Therefore, a change of direction as the flow of flushing water changes from the transverse direction to the vertical direction before the discharge opening of the discharge trap is made smooth to prevent water from coming off the bent part, thereby enabling a large force of water discharge to be ensured.

In addition, according to the invention, since the means for revising a distribution of the velocity of flow is provided near the jet water delivery port so that the velocity of flow substantially in the center of the jet water delivery port becomes the maximum, even if sewage exists in any position near the jet water delivery port, the velocity of flow sufficient to cause the syphoning action to be produced can be obtained.

Besides, according to the invention, the air discharging means provided in the jet water path allows the air within the jet water path to be rapidly discharged, thereby bringing about the effective action of the head (water head) of the flushing water tank.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DESCRIPTION OF THE PREFERRED EMBODIMENTS

Figure 1:
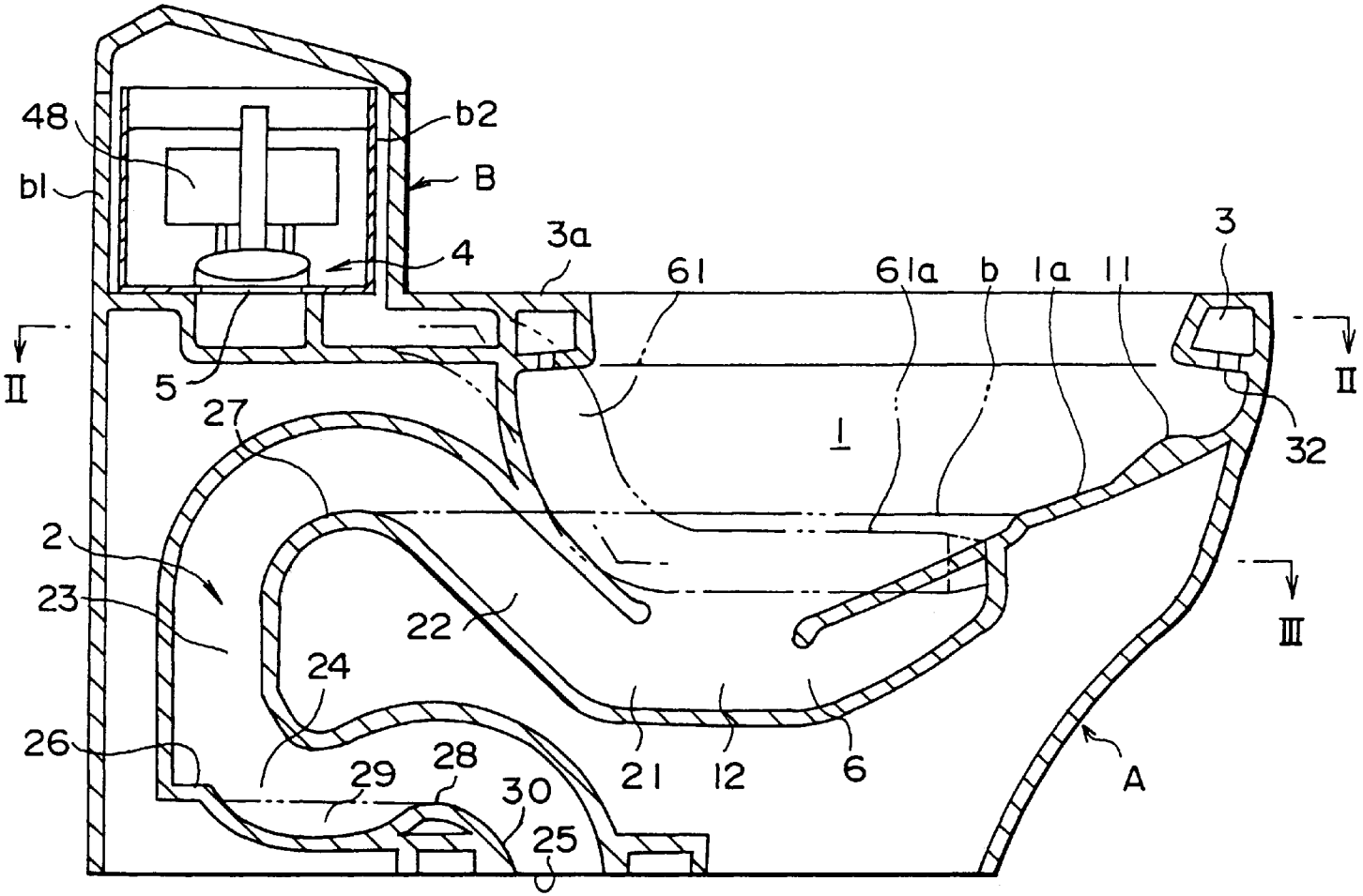
FIG. 1 is a central longitudinal sectional view showing an embodiment of a flush toilet bowl according to the present invention.

Now, an embodiment of the invention will be described on the basis of FIGS. 1 to 5. In the drawings, A indicates a toilet bowl body comprising a bowl part 1 and a discharge trap 2. The bowl part 1 is provided on the upper peripheral edge thereof with a water passing rim 3. Further, reference character B indicates a flush tank in which flushing water is stored and which is provided integrally with the toilet bowl body A at the back of the toilet bowl body A.

The flush water tank B in the present embodiment comprises an outer tank b1 integrally formed with the toilet bowl body A and an inner tank b2 made of a synthetic resin-molded part and housed and arranged within the outer tank b1, water level when the inner tank b2 is filled with water is adapted to reach a value of 100 mm to 120 mm.

Moreover, the bottom surface of the inner tank b2 of the flush water tank B is positioned at the same height as the rim surface 3*a* of the toilet bowl body, i.e., the upper surface of the water passing rim 3, and is provided with a discharge port 5 adapted to be closed and opened by a discharge valve 4.

Figure 5:
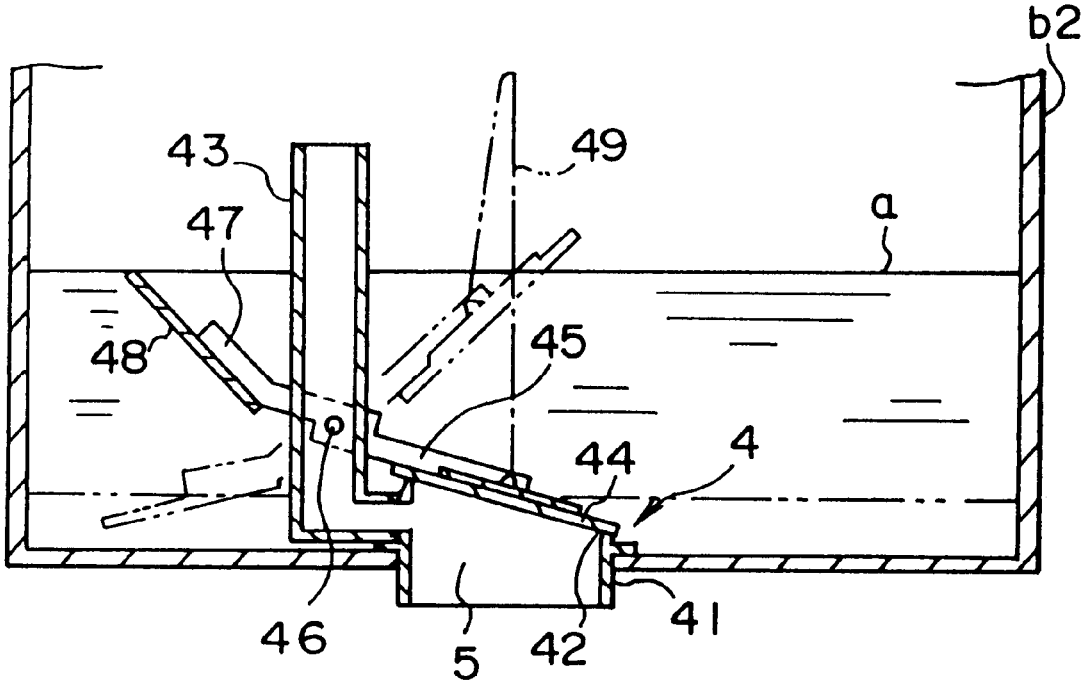
FIG. 5 is an enlarged sectional view of a portion of a flush water tank and shows a closed valve situation of a discharge valve in full line and an opened valve situation thereof in two-dots chain line.

The above-described discharge port 5 is basically constituted by a cylindrical discharge valve body 41 provided at the bottom of the flush water tank B so as to penetrate the bottom, as shown in FIG. 5. The inner diameter of the discharge part 5 is 70 mm to 75 mm larger than the inner diameter of the discharge port of a conventional general flush tank which is 50 mm.

The above-described discharge valve body 41 constituting the discharge port 5 has an upper end extending and opening into the inner tank b2 and cut obliquely, the opening edge of which constitutes a valve seat 42 for the discharge valve 4. Further, the discharge valve body 41 is provided with an overflow tube 43 which rises from the lateral side of the discharge valve body and communicates at the lower end thereof with the discharge port 5. This overflow tube 43 also serves as a support for a valve body 44. The above-described valve seat 42 is pivotably connected to the base of the overflow tube 43.

The valve body 44 is of a disc shape and is provided on the upper surface thereof with a pair of support arms 45 extending parallel to said upper surface. The support arms 45, 45 are pivotably connected to the overflow tube 43 at a shaft 46 with the overflow tube 43 held therebetween.

Accordingly, the valve body 44 is pivotally movable about the pivotably supported part of the arms 45 in the vertical direction. The upward pivotal motion causes the valve body 44 to be moved away from the valve seat 42, thereby opening the discharge valve 4 which in turn opens the discharge port 5. The downward pivotal motion from such an opened valve situation causes the valve body 44 to rest on the valve seat 42, thereby closing the discharge valve 4 which in turn closes the discharge port 5.

On the upper surface of the valve body 44 in the center thereof is connected an operating force-transmitting member 49 such as a chain to transmit the operating force of an operating means (not shown) provided on the side wall of the tank body A. Operation of the operating member causes the valve body 44 to be pulled up and pivotally moved in the upward direction so that the discharge valve 4 can be opened. In the meantime, the water passing rim 3 of the toilet bowl body A is formed so that it extends to the interior of the bowl part 1 over the entire periphery of the upper end of the bowl part 1 and the bottom thereof faces on the interior of the bowl part 1. The water passing rim 3 communicates with the discharge port 5 of the flush water tank B by way of the rim water path 31 on the center line which divides the toilet bowl body A into the two right and left parts.

Figure 2:
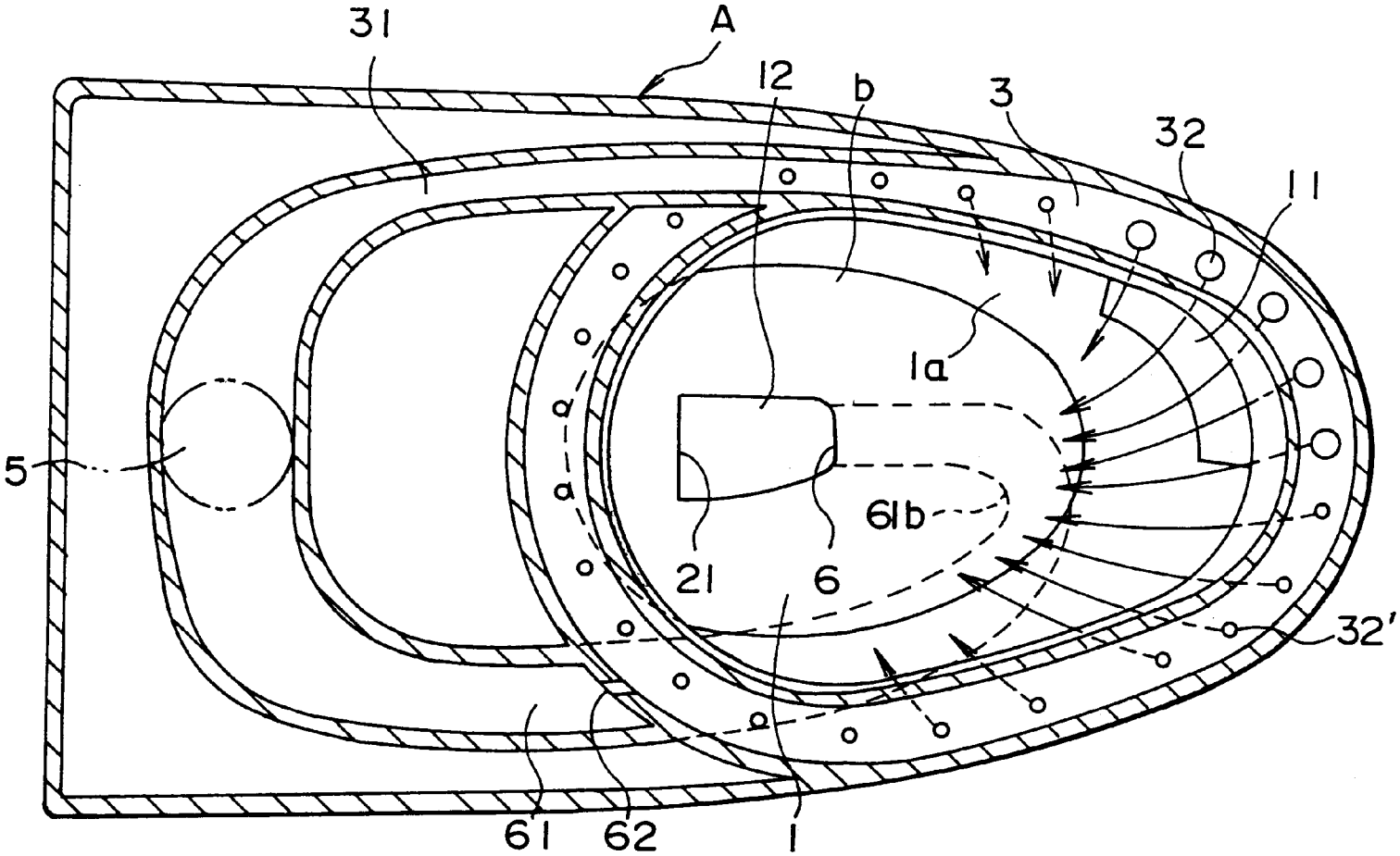
FIG. 2 is a sectional view taken along line II—II in FIG. 1.
Figure 3:
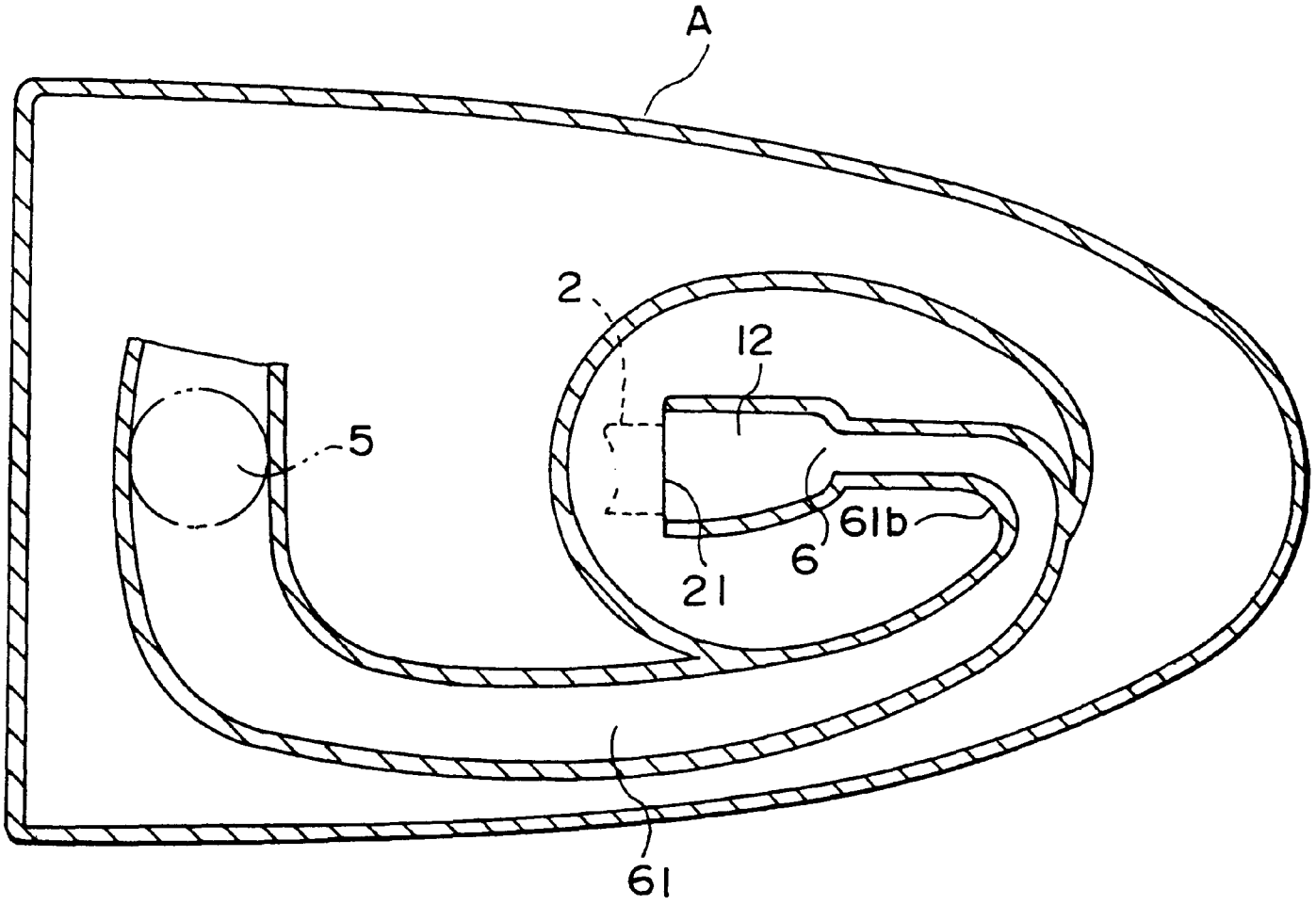
FIG. 3 is a sectional view taken along line III—III in FIG. 1.
Figure 4:
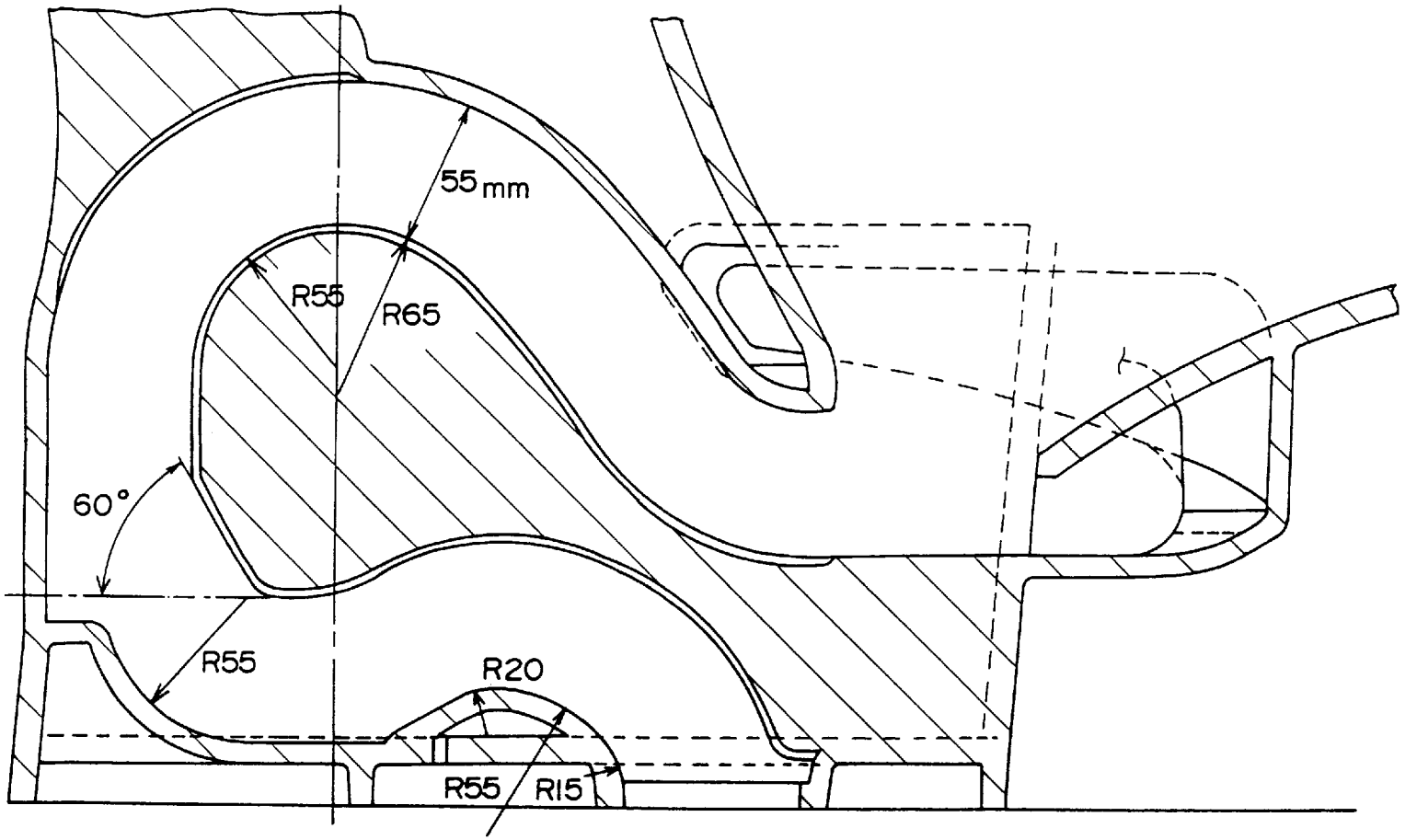
FIG. 4 is an enlarged longitudinal sectional view showing the detail of a discharge trap.

The rim water path 31 is so formed that it is distributed to the right, while to the left is a jet water path 61, which will be described later, with respect to the center line which divides the toilet bowl body A into the two right and left parts, as shown in FIG. 2. The rim water path 31 communicates with the rim 3.

The above-described water passing rim 3 is provided at the bottom thereof with rim water outlet holes 32, 32' over the entire periphery. The rim water outlet holes 32 positioned near the front end of the toilet bowl each have a diameter larger than the other rim water outlet holes 32' and are arranged deflected to any one side of the right and left of the toilet bowl body A, to the left in the drawing.

Accordingly, the flushing water, which flows from the discharge port 5 of the flush water tank B into the water passing rim 3 by way of the rim water path 31, flows out of the rim water outlet holes 32, 32' and is supplied into the bowl part 1 along the bowl surface 1*a,* includes a rotating main flow (in this case, rotates to the right) which is formed by the water flowing out of the rim water outlet holes 32 with larger diameters provided near the front end of the above-described toilet bowl.

This main flow has a function of revising a distribution of the velocity of flow from a jet delivery port which will be described later.

The bowl part 1 is formed with a horizontal portion 11 in a position below the above-described rim water outlet holes 32 having large diameters. The existence of this horizontal portion 11 prevents water from concentrating in the direction of stopping the above-described rotation and maintains the good rotation, even if a force of the supplied flushing water is reduced and the direction of the water delivered from the rim changes, and thus efficiently functions for the effective discharge of sewage and the improvement of the flushing property of the bowl surface.

Moreover, the bowl part 1 forms a sewage dropping recess 12 at the bottom thereof, which is provided at the back wall portion thereof with an inlet 21 of the discharge trap 2 and at the front wall portion with a jet delivery port 6 facing the above-described discharge trap inlet 21.

This jet delivery port 6 is separately provided independently of the rim water path 31 and water passing rim 3 and communicates with the above-described discharge port 5 by way of a jet water path 61 which is distributed to the left, while to right is the rim water path 31, with respect to the center line, which divides the toilet bowl body A into the two right and left parts.

Accordingly, the flushing water, which is supplied from the flush water tank B to the toilet bowl A, is divided into two parts, i.e., one part thereof flowing through the rim water path 31 and water passing rim 3 and being supplied to the bowl part 1 from the rim water outlet holes 32, 32', as described above, and the other part flowing through the jet water path 61 and being discharged directly toward the discharge trap inlet 21 from the jet delivery port 6, so that a large amount of water is fed into the discharge trap 2 at a time and, simultaneously, sewage is strongly pressed into the discharge trap 2.

Raising a water delivery ratio at the jet side is preferable for the production of a syphon, however, the flushing water at the rim side is also necessary to some degree for forming the rotating flow within the bowl part 1 and ensuring the performance of flushing the bowl. Taking the property of water saving into consideration, in the case where, for example, 6 liters of water is flushed, the distribution of flushing water is preferably in a range of rim side: jet side=1:4 to rim side: jet side=2:3.

Hereupon, the jet water path 61 will be described. In general, a syphoning toilet bowl having the jet water path 61 waits in an unused state with air gathered in a portion of the water path 61. When water is discharged out of the flush water tank B, it flows through the jet water path 61 while discharging such air.

At this time, jet water from the tank is most strongly drawn out when the jet water path 61 is filled with water. In other words, since in the situation of air remaining within the jet water path 61, the air causes troubles and jet water cannot be sufficiently ensured and the tank head cannot be effectively utilized. Accordingly, how rapidly the air within the path can be discharged is considerably important for the jet water path 61.

A way of pressing air out of the jet delivery port 6, a way of providing an air extracting hole inside the water path 61 (preferably, at the upper portion of the water path 61) are considered in order to extract the air within the jet water path 61. The former is accompanied by energy loss in order to press air in, and so the latter is preferable.

However, assuming that the air extracting hole is provided at the upper portion of the jet water path 61, in the case where the jet water path 61 is obliquely connected to the discharge port 5 and jet water delivery port 6 (the conventional toilet bowls with jet water paths mostly being of such construction), water rapidly flows down through the jet water path 61, however, water flows along the bottom of the water path 61, and so the air within the water path 61 is drawn by the water which flows down, and is only extended but is not discharged, so that when the force of water becomes weak, the air grows into lumps, which come to close the jet water path 61.

Figure 6:
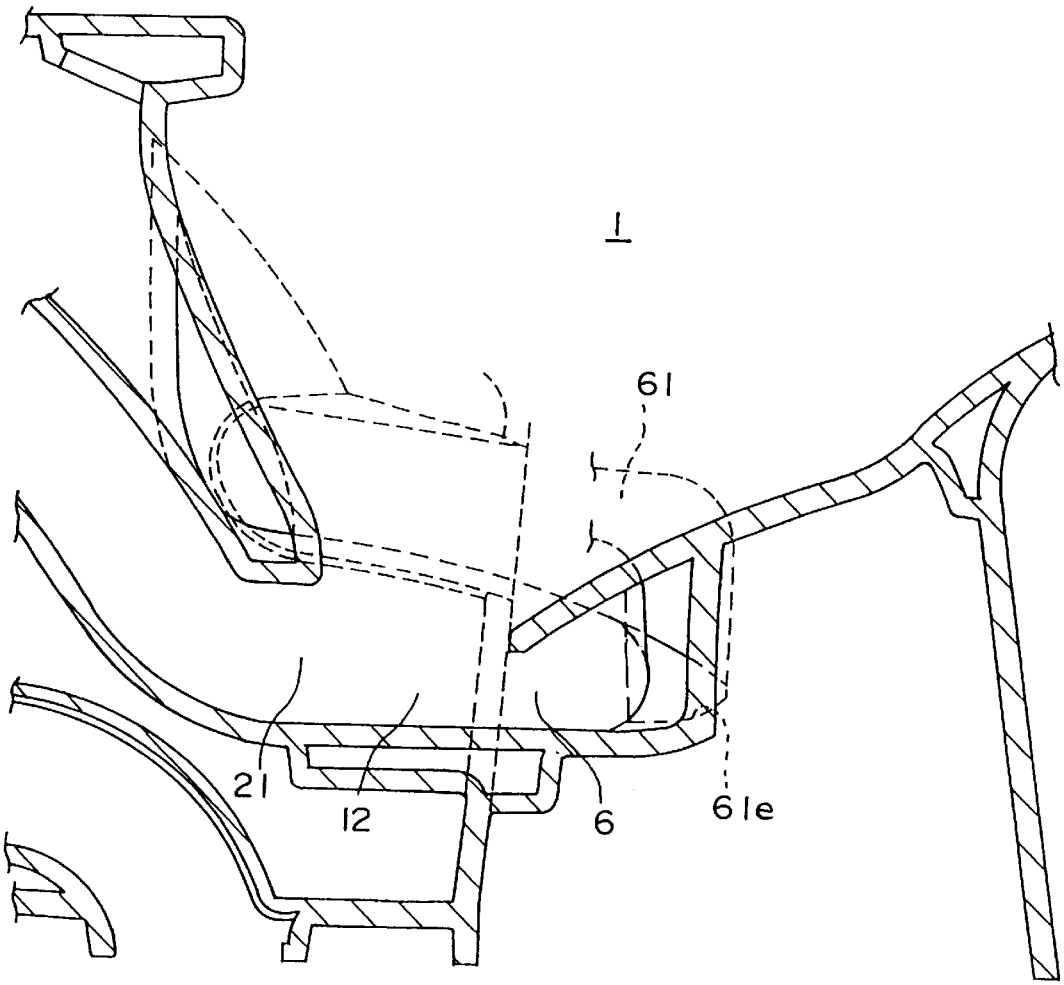
FIG. 6 is a fragmentary enlarged perspective view showing the vicinity of a jet water delivery port of a jet water path.

In order to solve such a problem, the jet water path 61 in the present embodiment is formed so that it is made substantially horizontal directly below the surface of the gathered water to form a horizontal part 61*a* passing around toward the front part of the toilet bowl body A. Further, the horizontal part 61*a* is turned by 180 degrees at the front part of the toilet bowl body A and, thereafter, drops in a straight line toward the jet delivery port 6. Further, in order to revise the influence of the centrifugal force, as shown in FIG. 6, the bottom surface of the portion of the water channel 61, where a change of direction is made by passing around to the front part of the toilet bowl body A, is formed with an inwardly inclined portion 61*e*. The radius of curvature of the bent portion 61*b*, where a change of direction of the jet water path 61 is made turning by 180 degrees toward the jet delivery port 6 at the front part of the toilet bowl body A, amounts to a value of 20 to 30 mm. In addition, the upper portion of the jet water path 61 is partially made adjacent to the water passing rim 3 and is provided at this adjacent portion with an air extracting hole 62 which passes through to the water passing rim 3 (refer to FIG. 2).

This construction of the jet water path 61 in the present embodiment allows the water, which has flowed down passing through the discharge port 5 from the flush water tank B, to be stopped at the horizontal part 61*a*, although instantaneously, so that the water gathered therein is formed in a short time between the flush water tank B and the horizontal part 61*a* and the surface of the gathered water rises. As a result, the air within the jet water path 61 is pushed up by the water, passes through the air extracting hole 62 into the water passing rim 3 and is discharged passing through the rim water outlet holes 32, 32'. Thereafter, the jet water path 61 becomes filled with water and the jet water is strongly drawn out. Namely, the air within the jet water path 61 is rapidly discharged, thereby allowing the tank head (water head) to be effectively utilized. In this connection, in the situation where the tank head acts on the interior of the jet water path 61, the energy supplied to the flushing water is determined depending purely on the fall between the flush water tank B and the jet delivery port 6. Therefore, any resistance due to the provision of the horizontal part 61*a* can be ignored. Moreover, since the radius of curvature of the bent portion 61*b*, where the direction of the jet water path 61 is turned by 180 degrees at the front part of the toilet bowl body A toward the jet delivery port 6, amounts to a value of 20 to 30 mm, the loss due to the change of direction of the flow in this portion also is small.

Figure 7A:
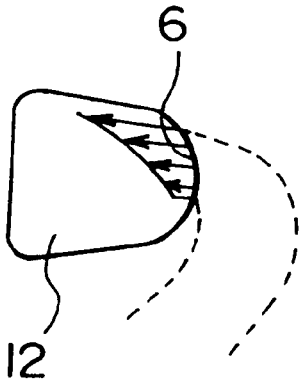
FIGS. 7(*a*) and 7(*b*) are views showing a distribution of the velocity of flow of the delivered jet water, (a) showing a situation of the deflected distribution of the flow velocity and (b) showing a situation of the uniform distribution of the flow velocity.
Figure 7B:
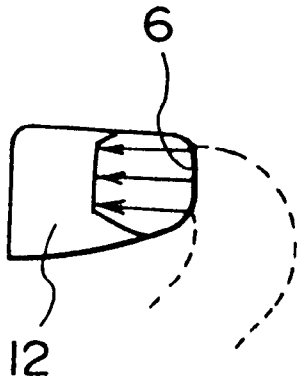

Further, making the jet water path 61 pass around up to the front part of the toilet bowl body A and making the jet water fall in a straight line from the front part of the toilet bowl body A toward the jet delivery port 6, as well as providing the inwardly inclined part 61*a* at the bottom of the water path 61 at the portion, where the above-described jet water path 61 passes around, produces hardly any centrifugal force in the water delivered from the jet delivery port 6; so, a distribution of the velocity of flow from the jet delivery port 6 becomes uniform, as shown in FIG. 7(*b*).

Making the distribution of the velocity of flow from the jet delivery port 6 uniform in this way, causes the water and sewage to be pressed by a flow of flushing water and sewage distributed in the form of a plane, and so a force of pressing the water and sewage becomes strong, thereby enabling an increase in the discharging force to be expected. In this connection, in the case of the deflected distribution of the velocity of flow as shown in FIG. 7(*a*), water and sewage are pressed by a flow of flushing water and sewage distributed not in the form of a plane but in the form of lines, and consequently, a force of pressing the sewage and water becomes weak.

In addition to the means of revising a distribution of the velocity of flow having the above-described construction, it is also possible to revise a distribution of the velocity of flow by a force of rotation due to the above-described rim water outlet holes 32, 32'.

Figure 8:
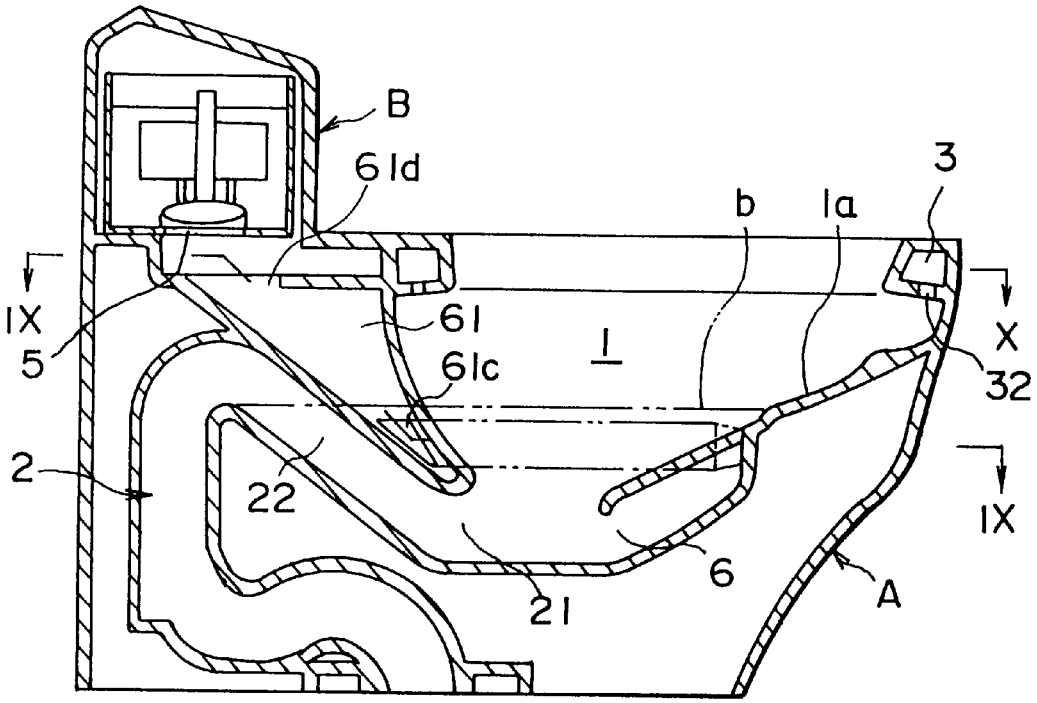
FIG. 8 is a central longitudinal sectional view showing another embodiment of the invention.
Figure 9:
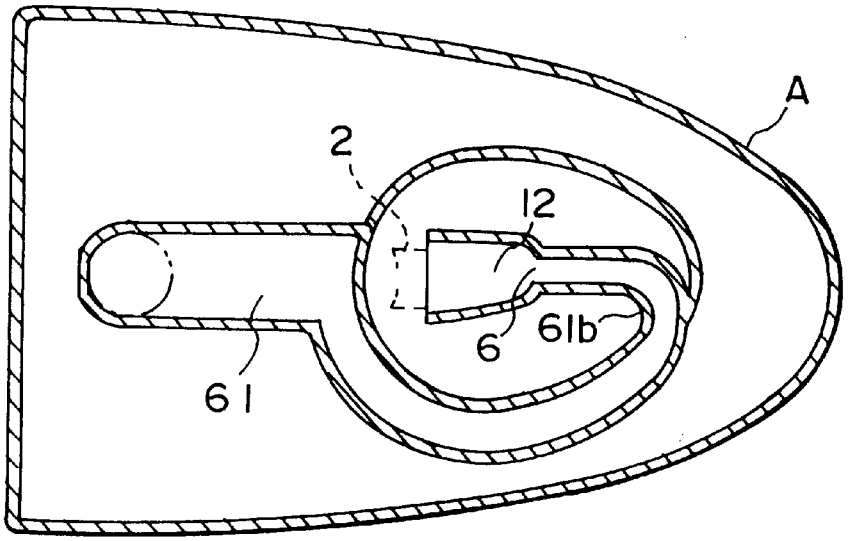
FIG. 9 is a sectional view taken along line IX—IX in FIG. 8.

Further, as a construction of the jet water path 61 and the water passing rim 3 passing around, the construction as shown in FIGS. 8 to 11 other than the construction described above is also possible. This construction has a feature in that the jet water path 61 is provided in a position behind the discharge trap 2, as shown in FIG. 8.

The jet water path 61 provided in a continuous way to the discharge port 5 of the flush water tank B extends, in the position behind the discharge trap 2, along a rising channel 22 of the discharge trap described later, up to the vicinity of the root of the discharge trap 2, passes through the hole 61*c* provided in the side wall in the vicinity of the root and changes direction to the transverse direction. Thereafter, the jet water path 61 passes around to the front part of the toilet bowl body A along the back surface of the bowl part 1 and communicates with the jet delivery port 6 provided facing the inlet 21 of the discharge trap. Further, the jet water path 61 is disposed so that the portion existing in front of the hole 61*c* of the side wall is turned around in a position below the surface b of the gathered water, in order to reduce the initial air within the path as far as possible.

At the upper portion of the jet water path 61 in a position behind the discharge trap 2 is provided a branch opening 61*d* for the water passing rim 3, by way of which the water passing rim 3 also communicates with the discharge port 5 of the flush water tank B.

This construction causes the water, which has flowed out of the discharge port 5 of the flush water tank B, to first flow down through the jet water path 61 in a position behind the discharge trap 2 and to enter the hole 61*c* provided in the side wall near the root of the trap 2. At this time, because of a large change in the direction of flow, a resistance of piping occurs. This causes a large amount of water supplied from the tank B to gather in the water path 61 in a short time, so that the surface of the gathered water begins to rise. Thus, the tank head comes to act on the interior of the water path 61 and, simultaneously, water is supplied to the water passing rim 3 by way of the branch opening 61*d*. Moreover, since the above-described branch opening 61*d* opens into the atmosphere by way of the water passing rim 3, the air within the jet water path 61 is discharged to the outside by way of the rim 3, thereby enabling action of the tank head to be easily introduced.

As an alternative to the air discharging means having such construction, the air in the upper portion of the jet water path 61 may be discharged to the outside of the jet water path 61 by means of a pump or the like in synchronization with a valve opening operation of the discharge valve.

Figure 10:
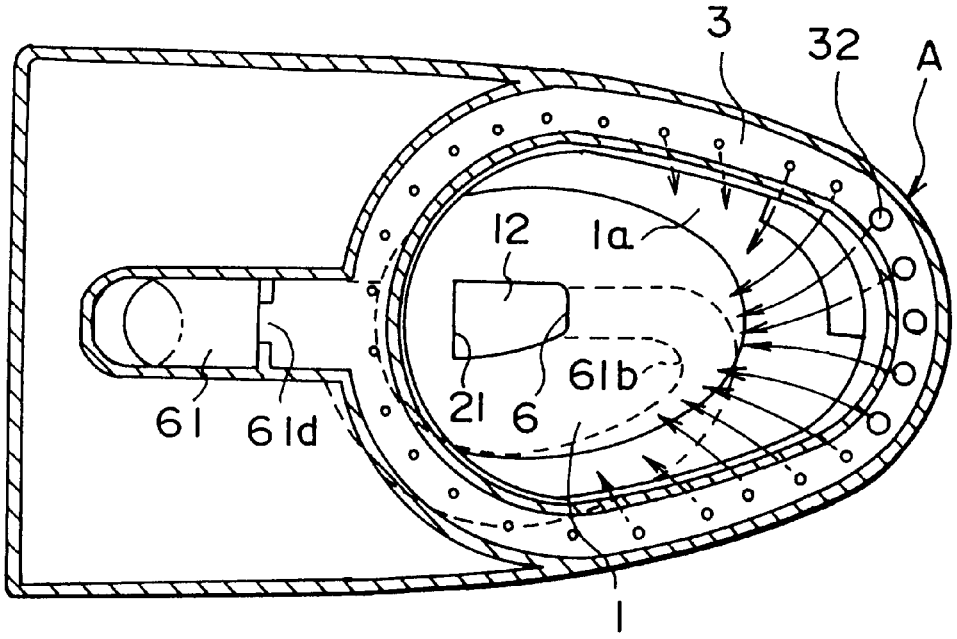
FIG. 10 is a sectional view taken along line X—X in FIG. 8.
Figure 11:
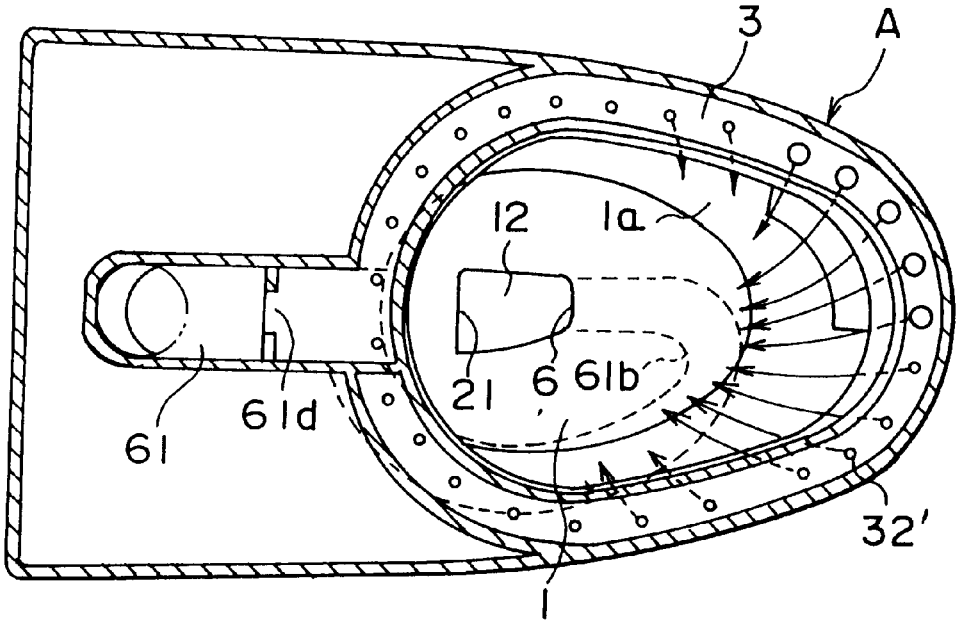
FIG. 11 is a view corresponding to FIG. 10, showing a modification of the embodiment shown in FIG. 10.

As for the flush water, which flows into the water passing rim 3 and is supplied to the interior of the bowl part 1 along the bowl surface la from the rim water outlet holes 32, 32', a construction of the water passing rim 3 being turned in both directions or in a single direction, as shown in FIGS. 10 and 11, allows the flushing water to flow with or without a rotation.

Advantages of the construction of the jet water path according to the present embodiment lie in that a force of the jet flow is strong because of a course of the jet water path 61 being shortened. In addition, productivity is improved since it is possible to form the above-described water path 61 in one piece.

In the meantime, as shown in FIG. 1, the discharge trap 2 has the inlet 21 which opens into the sewage dropping recess 12 provided at the bottom of the bowl part 1. The discharge trap 2 is composed of a continuous bent flow channel, which comprises a rising channel 22 extending in the obliquely upward direction from the inlet 21 along the back surface of the bowl part 1 toward the back of the toilet bowl body A, a descending channel 23 extending substantially in the vertically downward direction from the upper end of the rising channel 22, and a cross-laid channel 24 extending from the lower end of the descending channel 23 toward the front of the toilet bowl body A in the transverse direction. The cross-laid channel 24 has at the forward end thereof a discharge opening 25 which opens in the vertical direction. Further, when a phenomenon of the flow of water coming off the weir 27 occurs, the water which came off the weir collides with the back side wall of the descending channel 23 of the discharge trap and forms water turbulence, which draws air, making the rapid discharge of air impossible. Therefore, as a radius of curvature of the weir 27, a value of 50 to 75 mm (approximately 0.9 to 1.4 times the size of the diameter ϕ55 mm of the discharge trap), preferably a value of 55 to 65 mm (approximately 1.0 to 1.2 times the size of the diameter ϕ55 mm of the discharge trap), is recommended in order to prevent water from coming off the weir.

This discharge trap 2 is of a double seal construction which constitutes the seals at two points on the way thereof. A means 26 for promoting the production of syphon is formed so that the outer wall surface extending downwardly in the downstream side of the weir 27 protrudes like a horizontal step inwardly of the trap 2, thereby causing the water passing over the upper end of the rising channel 22, i.e., the weir 27 and falling on the descending channel 23 to collide with the horizontal step. Moreover, a second weir 28 is formed by an upwardly bent portion of the cross-laid channel 24 so as to form a gathered water part 29 before the discharge opening 25. Preferably, as the length of the horizontal step of the above-described means 26 for promoting the production of syphon, a value of 15 to 25 mm (approximately 0.25 to 0.45 times the size of the diameter ϕ55 mm of the discharge trap) is preferable, and the gathered water part 29 due to the second weir 28 is preferably formed so as to have a ventilation space above the gathered water part (approximately 0.45 to 0.65 times the size of the diameter ϕ55 mm of the discharge trap).

Further, the descending channel 23 is formed so that it is substantially cylindrical in shape in the direction of gravity and has a length of 100 to 150 mm (approximately 1.8 to 2.7 times the size of the diameter ϕ55 mm of the discharge trap) from the weir 27. The descending channel 23 is further formed so that the gathered water part 29 is positioned substantially directly below the descending channel 23. If the descending channel 23 has a diameter of 150 mm or more, the water which has passed over the weir 27 collides with the back side wall of the descending channel 23 before reaching the means 26 for promoting the production of syphon, and forms water turbulence into which air is drawn, making the rapid discharge of air impossible. If the descending channel 23 has a length of 100 mm or lower, no sufficient kinetic energy can be obtained to produce the seal in the means 26 for promoting the production of syphon, and in some cases the production of syphon does not occur.

Moreover, after the cross-laid channel 24 is bent upwardly to form the second weir 28, as described above, it is immediately bent in the downward direction to form a downward bent part 30, which in turn communicates with the discharge opening 25.

The above-described means 26 for promoting the production of syphon also has a function as a means 26 for revising the direction of flow. The position, where the flow direction revising means 26 is provided, is considerably important, and such means is provided in the position shown in the drawing, i.e., on the inner wall surface of the trap 2 at the portion where the descending channel 23 and the cross-laid channel 24 intersect with each other. Providing the flow direction revising means 26 in such a position allows the revision of an uneven distribution of the flow velocity to be performed, which usually occurs at the place, where the water has finished turning the bent part continuing from the descending channel 23 of the discharge trap to the cross-laid channel 24.

As for the position of the flow direction revising means 26, it is confirmed that the position higher than the center and lower than the ceiling wall by 10 to 20 mm with respect to the direction of height of the cross-laid channel 24, i.e., the level of substantially ⅔ of the ventilation space is most effective to perform the revision of a distribution of the velocity of flow and allows the air within the trap 2 to be rapidly discharged.

If the flow direction revising means 26 is provided at a position higher than the intersecting portion of the descending channel 23 and cross-laid channel 24, not only the distribution of the velocity of flow at the place, where the water has finished turning the bent part which continues from the descending channel 23 to the cross-laid channel 24, becomes uneven, but also the flow of water which is caused to be bent transversely by the flow direction revising means 26 in the form of a horizontal step sometimes becomes a flow which closes the trap 2, thus hindering the growth of syphon. Conversely, if this position is made lower than the above-described position, the effect of revising the velocity of flow becomes lower.

Further, the discharge trap 2 is formed so that the downward bent part 30 from the top of the bent part constituting the second weir 28 to the discharge opening 25 has a large radius of curvature of 40 to 65 mm (approximately 0.7 to 1.2 times the size of the diameter ϕ55 mm of the discharge trap), preferably 45 to 55 mm (approximately 0.8 to 1.0 times the size of the diameter ϕ55 mm of the discharge trap) and, simultaneously, the end of the discharge trap, in which the discharge opening 25 opens, reaches the same level as the bottom of the toilet bowl body A. Thus, a course of the water discharge is extended as long as possible. In the present embodiment, the downward bent portion 30 has a radius of curvature of 55 mm (1.0 times the size of the diameter ϕ55 mm of the discharge trap).

Figure 17A:
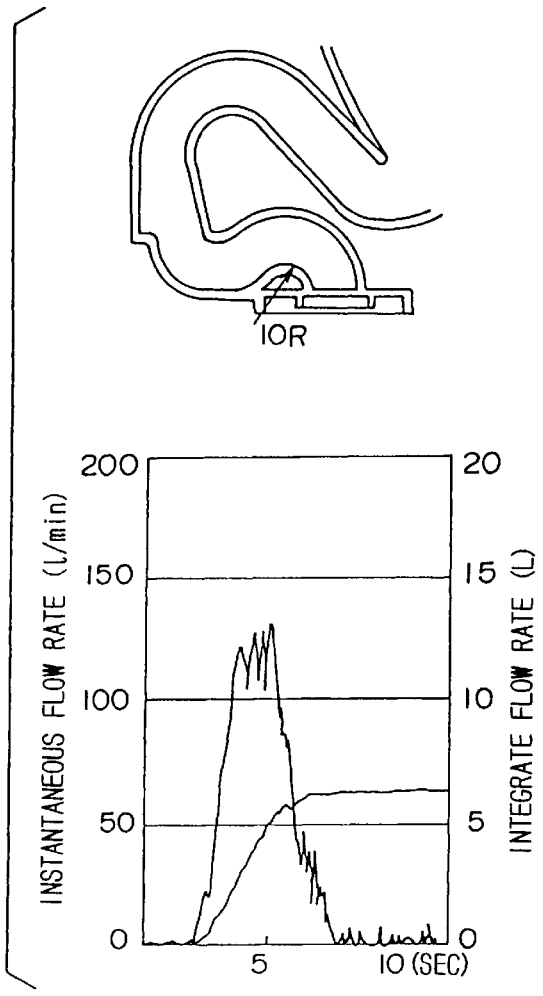
FIGS. 17(*a*) to 17(*d*) are views showing a relation between the radii of curvature of a bent part near the discharge opening of the discharge trap, (a) being of a radius of curvature of 10 mm, (b) being of a radius of curvature of 20 mm, (c) being of a radius of curvature of 55 mm, and (d) being of a radius of curvature of 55 mm and, simultaneously, showing a portion of the bent part continuously extended more downwardly than the discharge opening.
Figure 17B:
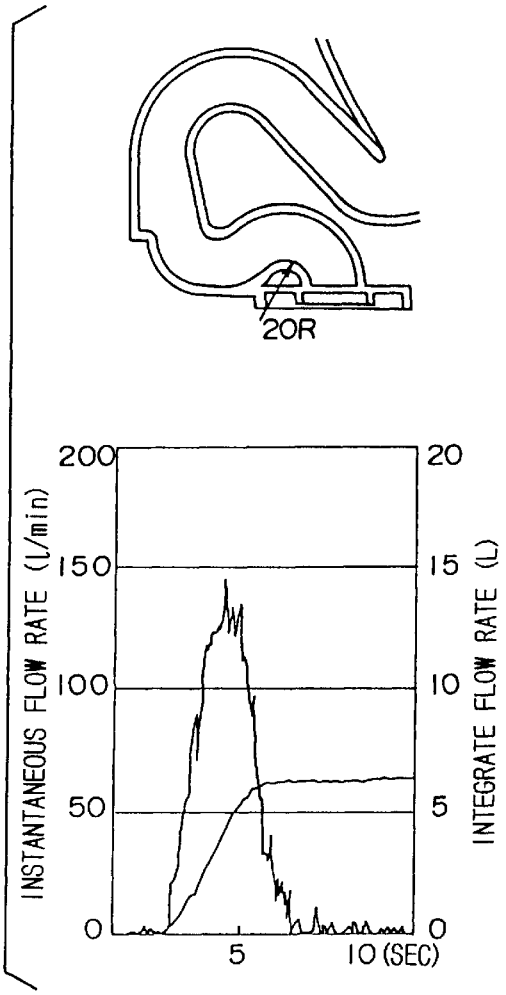
Figure 17:
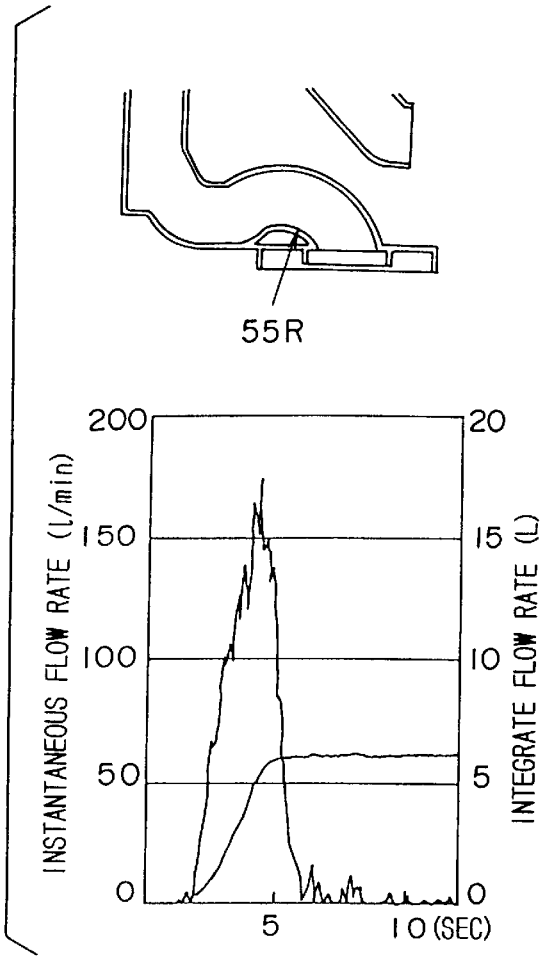
Figure 17:
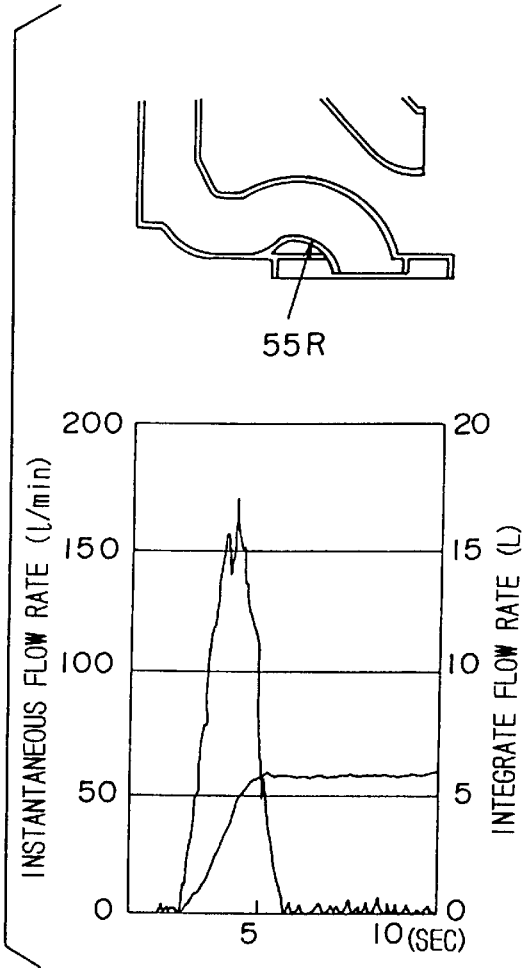

Moreover, FIG. 17 shows the water discharging characteristic, in which the radius of curvature of the downward bent part 30 from the top of the bent part constituting the second weir 28 of the discharge trap 2 to the discharge opening 25, is changed within a range of 10 to 55 mm.

As shown in FIG. 17, in the case where the downward bent part 30 which is formed from the top of the bent part constituting the second weir 28 of the discharge trap 2 to the discharge opening 25 is smaller in the radius of curvature than 55 mm, as described above, the peak value of an amount of the discharged water increases less. The reason is that, in the discharge trap 2 having the cross-laid channel 24, as the flow of water changes from the transverse direction to the vertical direction before the discharge opening 25, the flow comes off the wall surface of the trap 2 and jumps forwardly to thereby decrease the area of the actual flow path near the discharge opening 25, so that the flow of water which has come off the wall restricts the discharge of flushing water.

Namely, FIG. 17(*a*) shows the result of the experiment made using the bent part 30 having a radius of curvature of 10 mm. In this case, the peak value of an amount of the discharged water from the discharge opening 25 amounts to 127 liters/min. and the amount of flushing water amounts to 6.3 liters. Further, FIG. 17(*b*) shows a case of the bent part 30 having a radius of curvature of 20 mm, and the peak value of an amount of the discharged water amounts to 140 liters/min. and the amount of flushing water amounts to 6.3 liters.

As shown in FIG. 17(*c*), in the case where the bent part 30 has a radius of curvature of 55 mm, the peak value of an amount of the discharged water amounts to 164 liters/min., which rises substantially by 30 percent compared with that of the example of (a) having a radius of curvature of 10 mm, and the amount of flushing water decreases to 6.1 liters. However, it shows the fact that there are several steps on the graph until the amount of the discharged water reaches the peak value thereof, and a process of producing the syphoning action is not sufficiently smooth.

Hereupon, as shown in FIG. 17(*d*), an attempt is made to use the bent part 30 having a radius of curvature of 55 mm and to continuously extend the edge portion 25*a* of the discharge opening 25 from the bent part 30. In this case, a phenomenon of the flushing water, which flows over the bent part 30, coming off the wall is more effectively suppressed, and the peak value of an amount of the discharged water amounts to 165 liters/min. and the amount of flushing water to 5.9 liters. Simultaneously, the number of the steps on the graph up to the peak value decreases, thereby making it possible to produce the syphoning action more smoothly.

In the case where the radius of curvature of the bent part is made larger than the above-described radius of curvature, the gathered water part is pressed and the sealing property is damaged. Accordingly, no syphoning action is caused and no data can be obtained.

Figure 12:
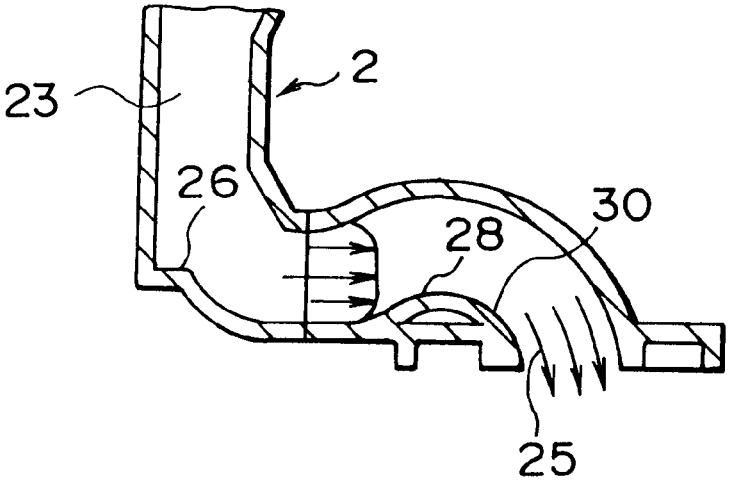
FIG. 12 is an explanatory view showing a distribution of the flow velocity in the vicinity of a discharge opening of the discharge trap.

Therefore, in the case where the radius of curvature is increased to a value of 40 to 65 mm (approximately 0.7 to 1.2 times the size of the diameter ϕ of the discharge trap), preferably a value of 45 to 55 mm (approximately 0.8 to 1.0 times the size of the diameter ϕ of the discharge trap), the above-described phenomenon is prevented and a change of direction of the flow is made smooth. Consequently, the effective action is performed to smoothly induce the flow to the discharge opening 25 (refer to FIG. 12), thus providing an increase in the force of water discharge.

Further, the basis, on which 100 to 120 mm is taken as a value of the water level of the inner tank b2 when filled with water and 70 to 75 mm is taken as a value of the diameter of the discharge port, will be described with reference to FIGS. 13 and 14.

Figure 13:
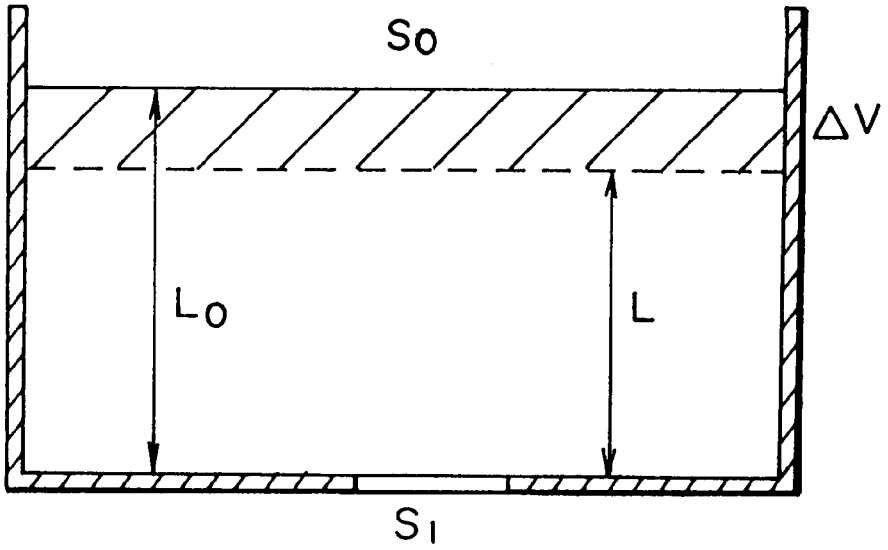
FIG. 13 is an explanatory view for explaining a relation between the height of the liquid surface in a flush water tank and the diameter of the discharge port as well as the instantaneous flow velocity of discharged water.

As shown in FIG. 13, if Lo represents the initial height of the surface of liquid, L the height of the surface of liquid after an elapse of Δt second, So the area of the liquid within the tank, S liter the sectional area of the discharge port, Vo the velocity of flow of the discharged water and ΔV the amount of the discharged water after an elapse of Δt second, (Equation 1)

$$Vo = \sqrt{(2gLo)}$$

(potential energy=kinetic energy)
(Equation 2)

$$\Delta V = Vo \times Sl \times \Delta t = \sqrt{(2gLo)} \times Sl \times \Delta t$$

The velocity of flow of the discharged water after an elapse of Δt second,
(Equation 3)

$$V = \sqrt{(2gL)}$$

(Equation 4)

$$L=(So \times Lo - \Delta V)/So$$

Figure 14:
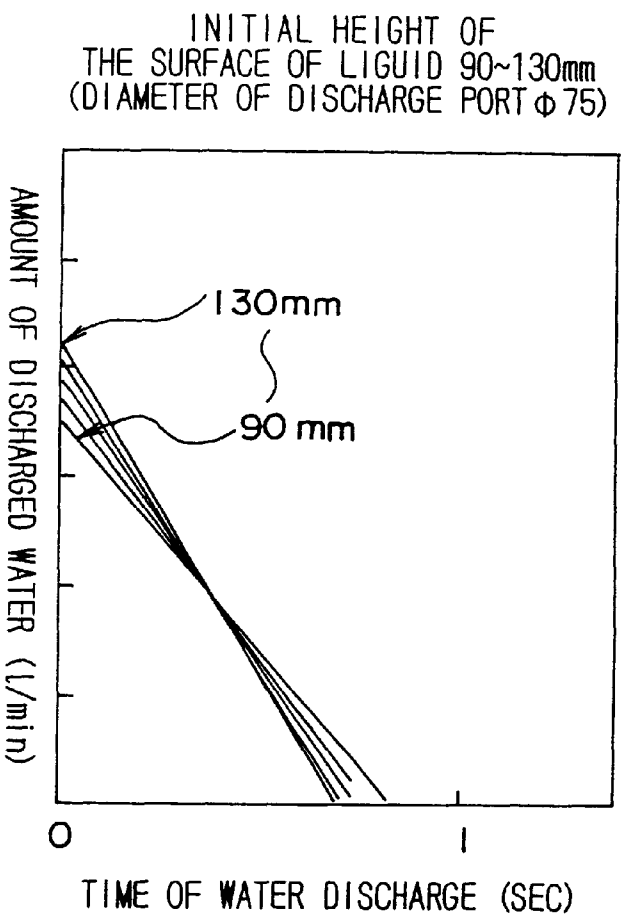
FIGS. 14(*a*) and 14(*b*) are graphs showing a relation between the diameter of the discharge port of the flush water tank and the flow rate of discharged water, (a) showing a graph in the case where the initial height of the liquid surface is kept constant and the diameter is changed and (b) showing a graph in the case where the diameter is maintained constant and the initial height of the liquid surface is changed.
Figure 14:
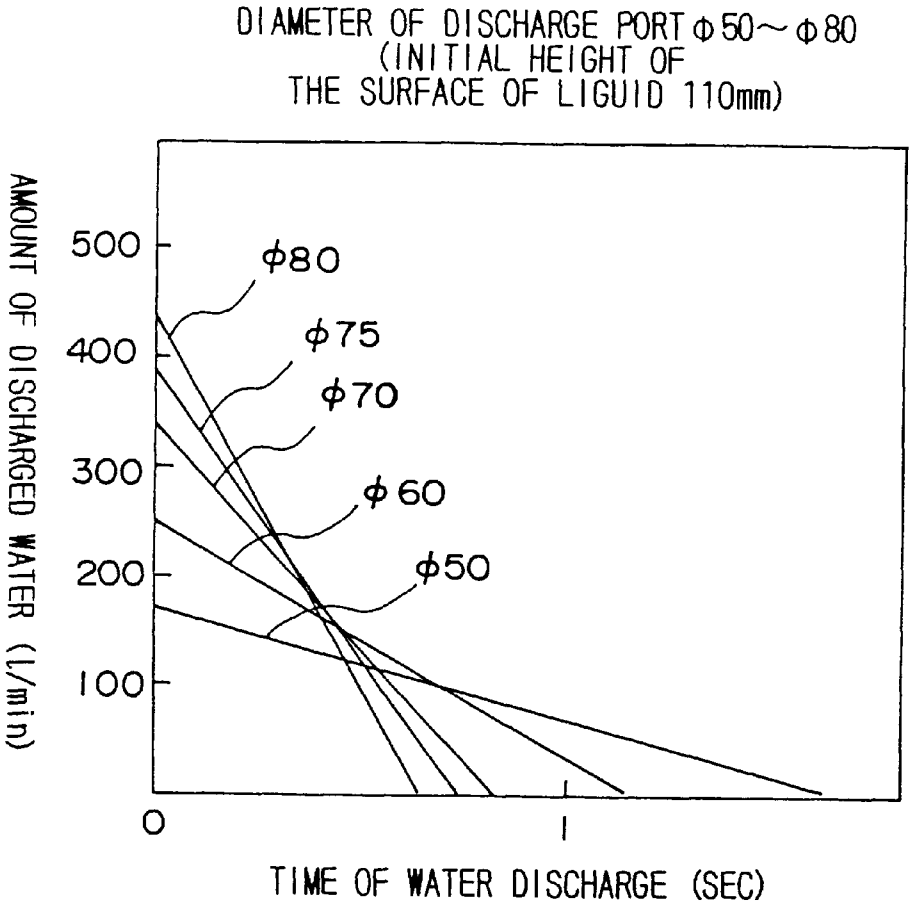

FIG. 14 shows a graph of the result obtained by calculating Δt, for example, every 0.2 seconds and obtaining the amount of the discharged water ΔV at each time. FIG. 14(*a*) shows the result calculated using the initial height of the surface of liquid of 110 mm and the diameter of the discharge port in a range of ϕ50 to ϕ80 mm as a parameter, and FIG. 14(*b*) shows the result calculated using the diameter of the discharge port of ϕ75 mm and the initial height of the surface of liquid in a range of 90 to 130 mm as a parameter.

Hereupon, it is empirically confirmed that the initial flow rate of 350 liters/min. and more and the time of supply of 0.7 seconds and more are necessary for production of the syphoning action in the case of the diameter ϕ55 mm of the discharge trap (taking only the production of the syphoning action into consideration, there is no upper limit in the time of supply, however, if the time of supply is too long, the amount of flushing water increases; so, if an attempt is made to suppress the amount of flushing water to 6 liters or so, the time of supply is preferably one second and below). This condition has a mutual relation to the trap sectional area of the discharge trap, and it is confirmed that the water of supply of 0.24 liters/min. and more per a sectional area of 1 square cm is required (taking only the production of the syphoning action into consideration, there is no upper limit in the amount of supply, however, if the amount of supply is too much, the amount of flushing water increases. Therefore, if an attempt is made to suppress the amount of flushing water to 6 liters or so, the amount of supply is preferably 0.30 liters/sec. and below per a sectional area of 1 square cm). Thus, offering the water of supply of 181 liters/min. and more, for example, in the case of the trap having the diameter ϕ40 mm, causes the syphoning action to be surely produced.

Therefore, as the values which satisfy the above-described condition, 100 to 120 mm for the initial height of the surface of liquid of and a range of 70 to 75 mm for the diameter of the discharge port can be selected from FIG. 14.

Figure 15:
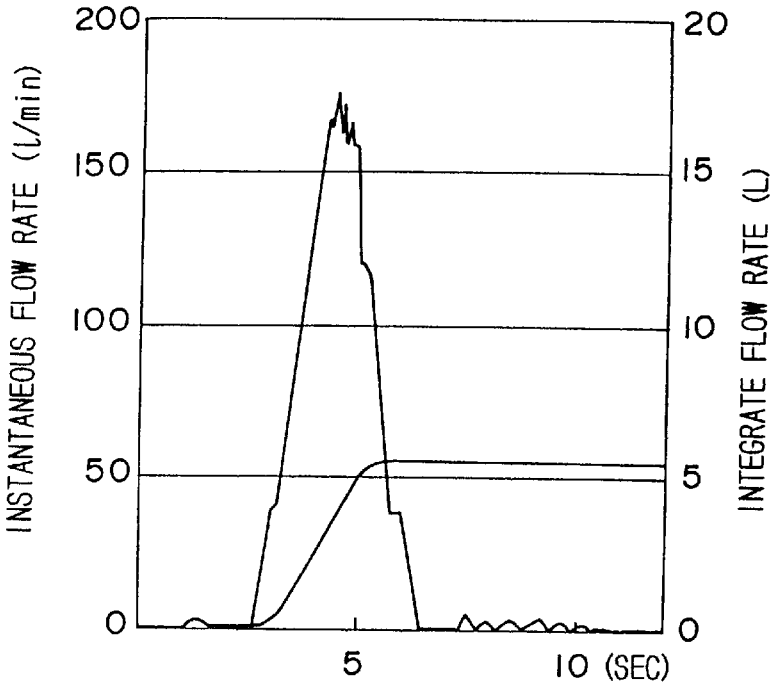
FIG. 15 is an explanative view showing a water discharging characteristic of the flush toilet bowl according to the present invention.
Figure 16:
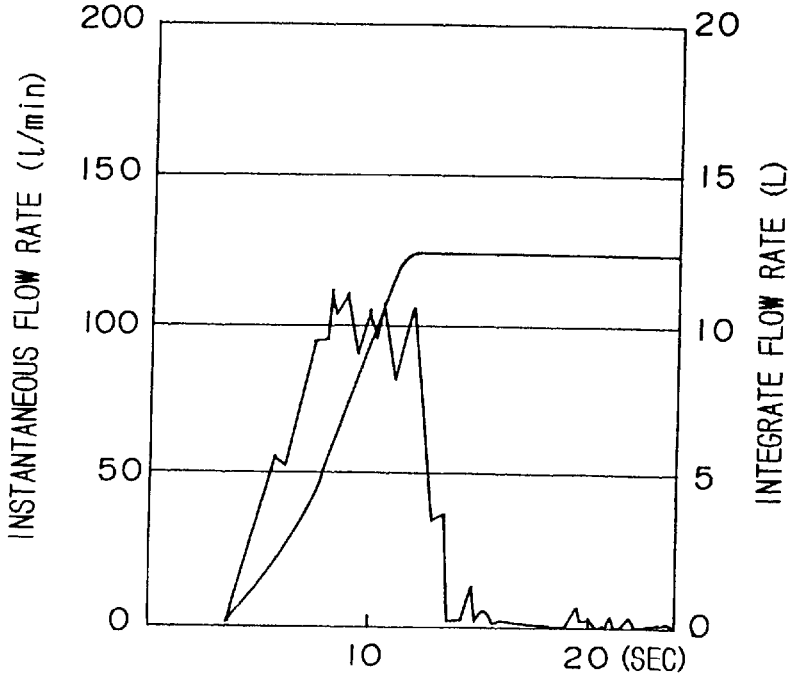
FIG. 16 is an explanative view showing a water discharging characteristic of a flush toilet bowl in the prior art.

An experiment is made for comparison of the performance of water discharge of the toilet bowl according to the invention having the construction as described above with a syphon vortex type toilet bowl which is typical as a conventional low silhouette type toilet bowl. As a result, the water discharging characteristic of the toilet bowl according to the invention is shown in FIG. 15, and the water discharging characteristic of the conventional low-silhouette type toilet bowl is shown in FIG. 16. As understood from these graphs, in the water discharging characteristic of the conventional low-silhouette type toilet bowl, the peak of the water discharge: 110 liters/min., the time required until the peak of the water discharge: 5.3 seconds, and the integrated flow: 12.7 liters, while in the water discharging characteristic of the toilet bowl according to the invention, the peak of the water discharge: 167 liters/min., the time required until the peak of the water discharge: 1.8 seconds and the integrated flow rate: 5.5 liters. However, in order to obtain the above-described result, it is important for the toilet bowl according to the invention that the velocity of flow of the jet of 1.3 m/sec. and more is required for a period of time of 1.4 seconds and more, and the sectional area of the opening of the jet lies within 30 to 60 percent of the sectional area of the trap. Moreover, the sectional area of the opening of the jet in the toilet bowls used in the present experiment are 10 square cm (as the trap is viewed to be a circle of the diameter of 55 mm, a ratio of the sectional area of the jet to that of the trap is 0.42).

In order to discharge the sewage within the toilet bowl with a small amount of flushing water, since there is insufficient pressing-out force due to the flushing water therefore, this must be compensated by the suction force due to the syphoning action. Further, the shorter the time taken to produce the syphoning action is, the smaller the amount of the supply of flushing water is. In this connection, the time required for conveying sewage by the continuation of the syphoning action has a mutual relation to the suction force. If the suction force is strong, the time required for conveying sewage can be made short.

Figure 18:
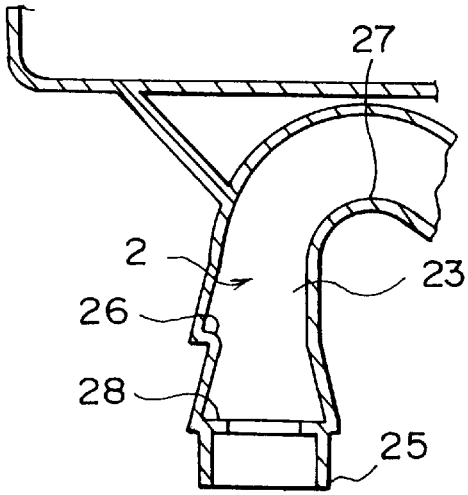
FIG. 18 is an enlarged fragmentary sectional view showing a further embodiment of the discharge trap.
Figure 19:
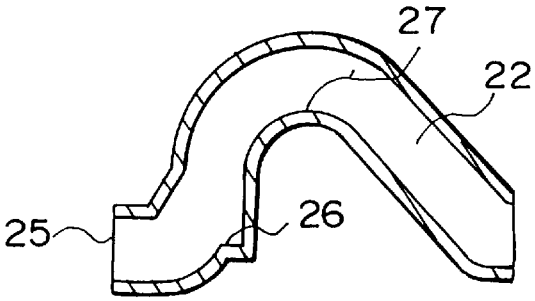
FIG. 19 is an enlarged fragmentary sectional view showing still a further embodiment of the discharge trap.
Figure 20:
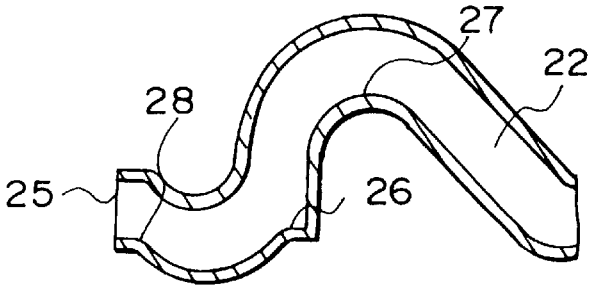
FIG. 20 is an enlarged fragmentary sectional view showing another embodiment of the discharge trap.

The water discharging characteristic obtained empirically with such a knowledge as a basis is that of the invention as described above. Therefore, if discharge traps having the above-described water discharging characteristic exist, replacement is possible also in the discharge traps having different constructions, which include, for example, the ones as shown in FIGS. 18 to 20. In the constructions shown in FIGS. 18 to 20, the same parts as the construction of each embodiment as described above are indicated by the same reference characters, and the explanation thereof is omitted.

Figure 21:
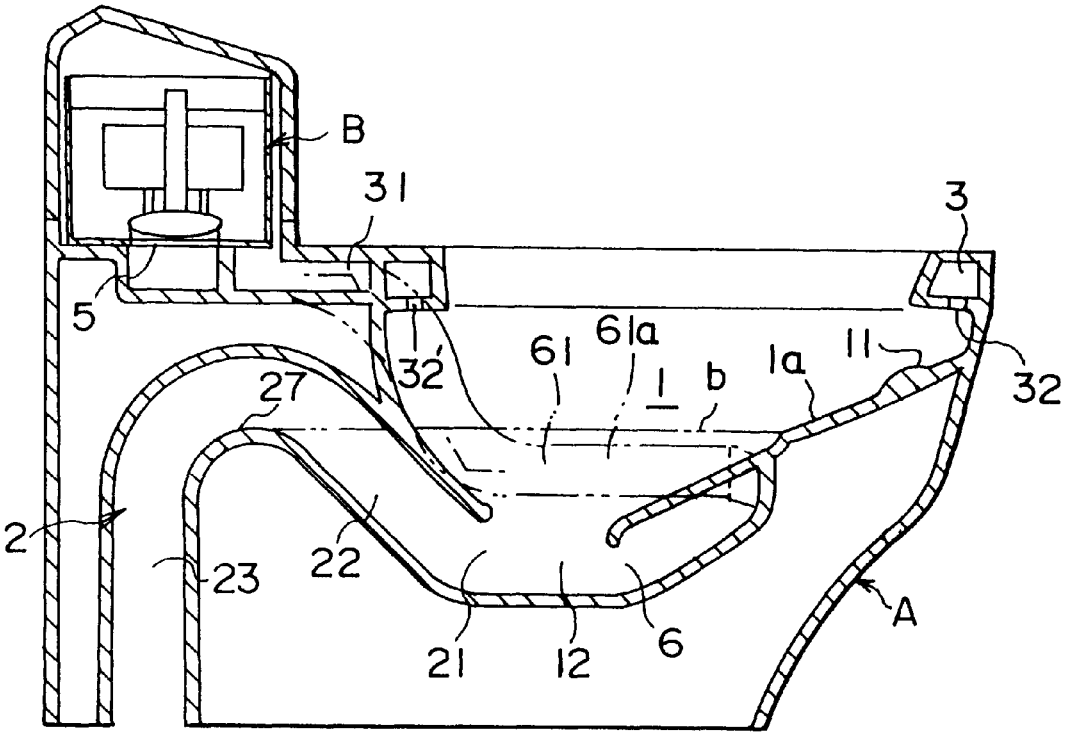
FIG. 21 is a central longitudinal sectional view showing a further embodiment of the flush toilet bowl according to the invention.

Moreover, designing the above-described jet water path 61 enables the production of the syphon to be ensured without providing any seal producing means in the discharge trap 2, as shown in FIG. 21. However, in this case, it is empirically confirmed to require a flow of 6 to 8 liters or so.

Further, another embodiment of the jet water path will be described.

Figure 22:
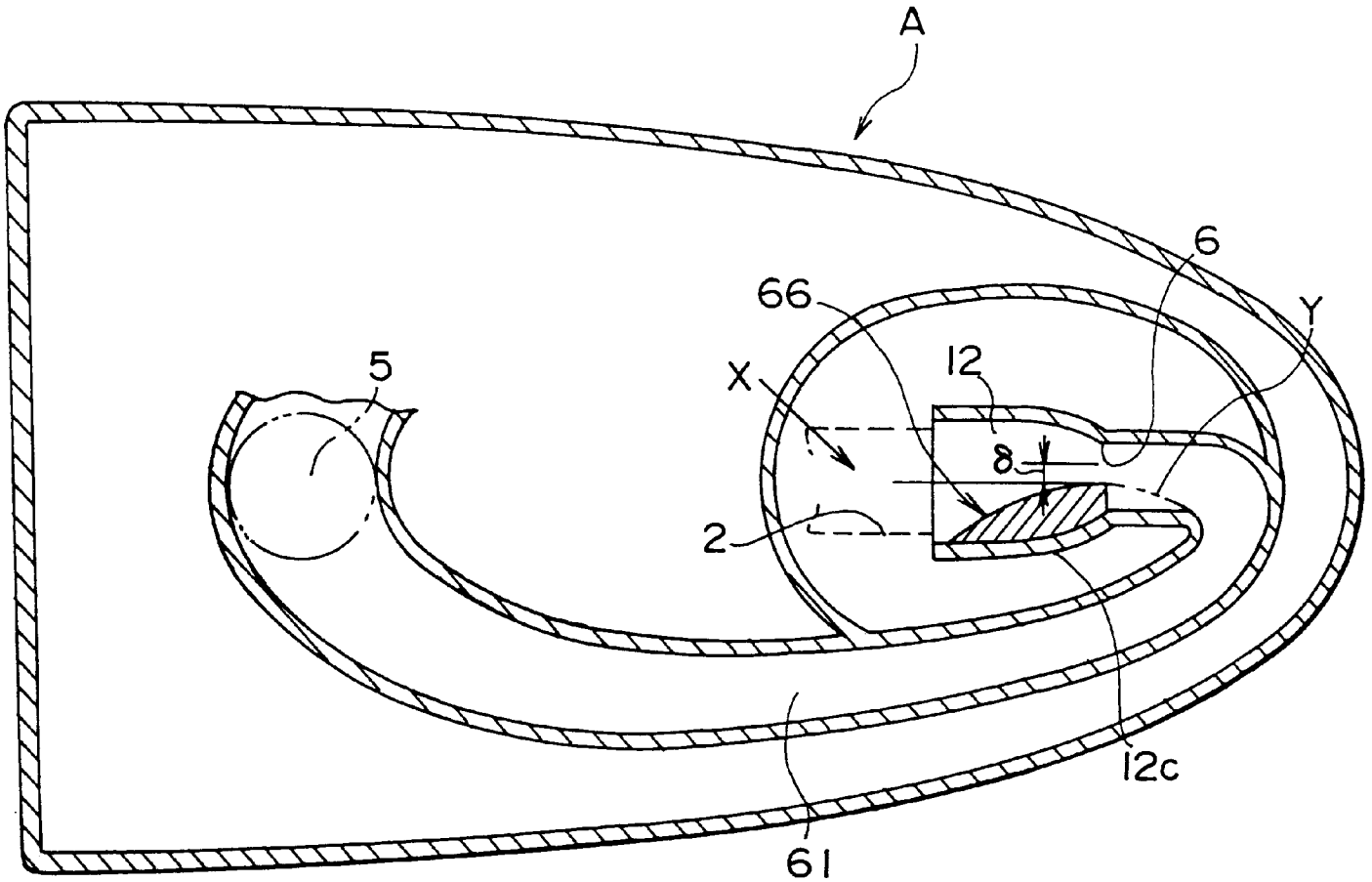
FIG. 22 is a cross-sectional view showing another embodiment of a jet water path.

In the embodiment shown in FIG. 22, the jet delivery port 6 of the jet water path 61 is additionally provided with an offset block. Namely, the sewage dropping recess 12 is additionally provided on the left wall 12*c* thereof with the offset block 66 in the form of a triangle so that the jet delivery port 6 is offset by 6 from the center of the discharge trap 2.

Figure 23:
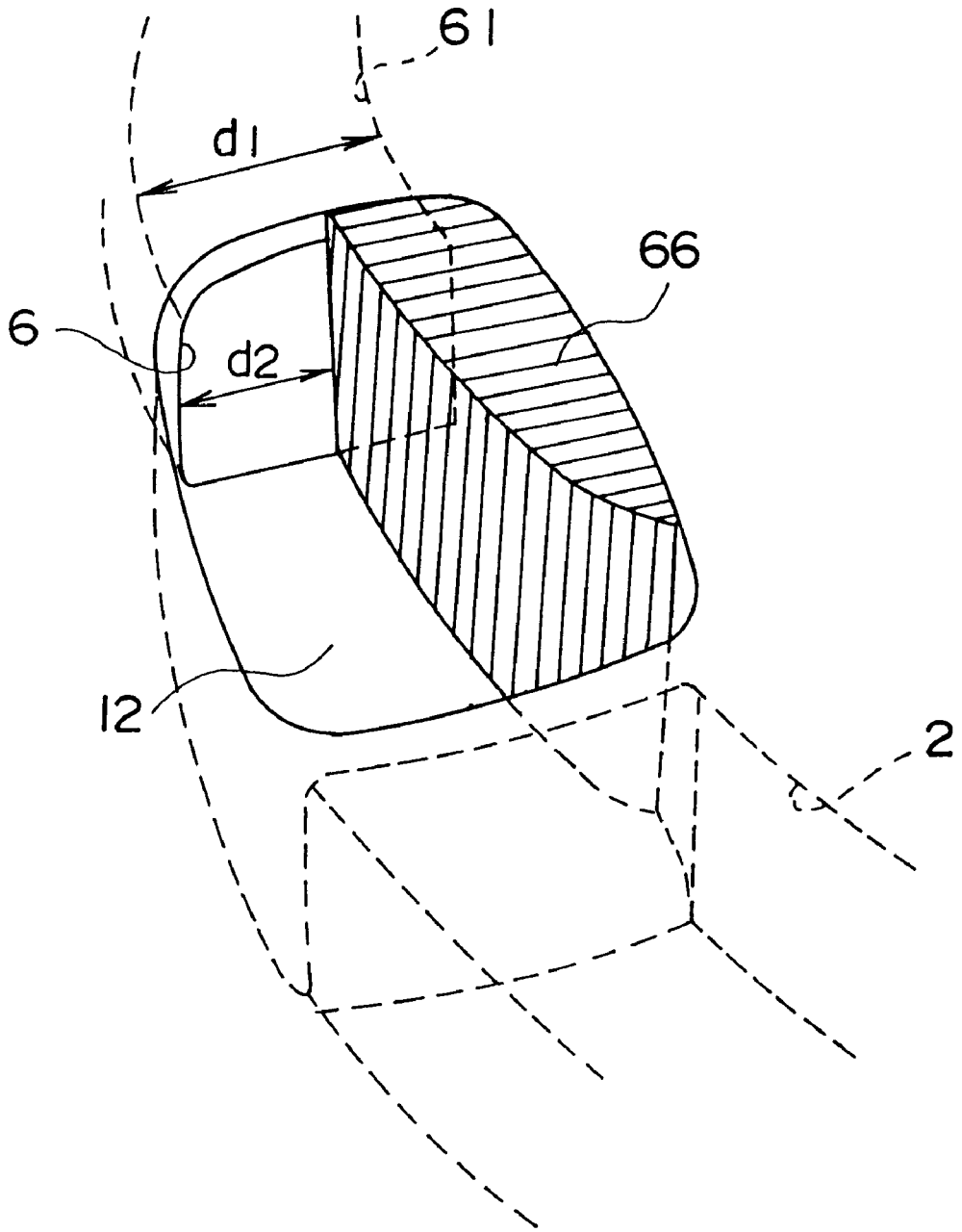
FIG. 23 is a fragmentary perspective view as viewed in the arrow-marked direction X in FIG. 22.

FIG. 23 is a perspective view as viewed from the arrow-marked direction X in FIG. 22, which shows that the jet delivery port 6 of the jet delivery path 61 having a width of d1 is blocked by the offset block 66, so that the jet delivery port 6 is reduced to a width of d2.

The above-described offset block 66 may be of a cross section in the form of a wing including the portion indicated by the two-dot chain line Y in FIG. 22. Since this embodiment can be produced only by additionally providing the offset block 66 in the toilet bowl A which is formed with the forward end of the jet water path 61 being aligned with the center of the toilet bowl, there is no anxiety of a steep rise of the cost of production and no extreme increase in the loss of the flow path.

Figure 24:
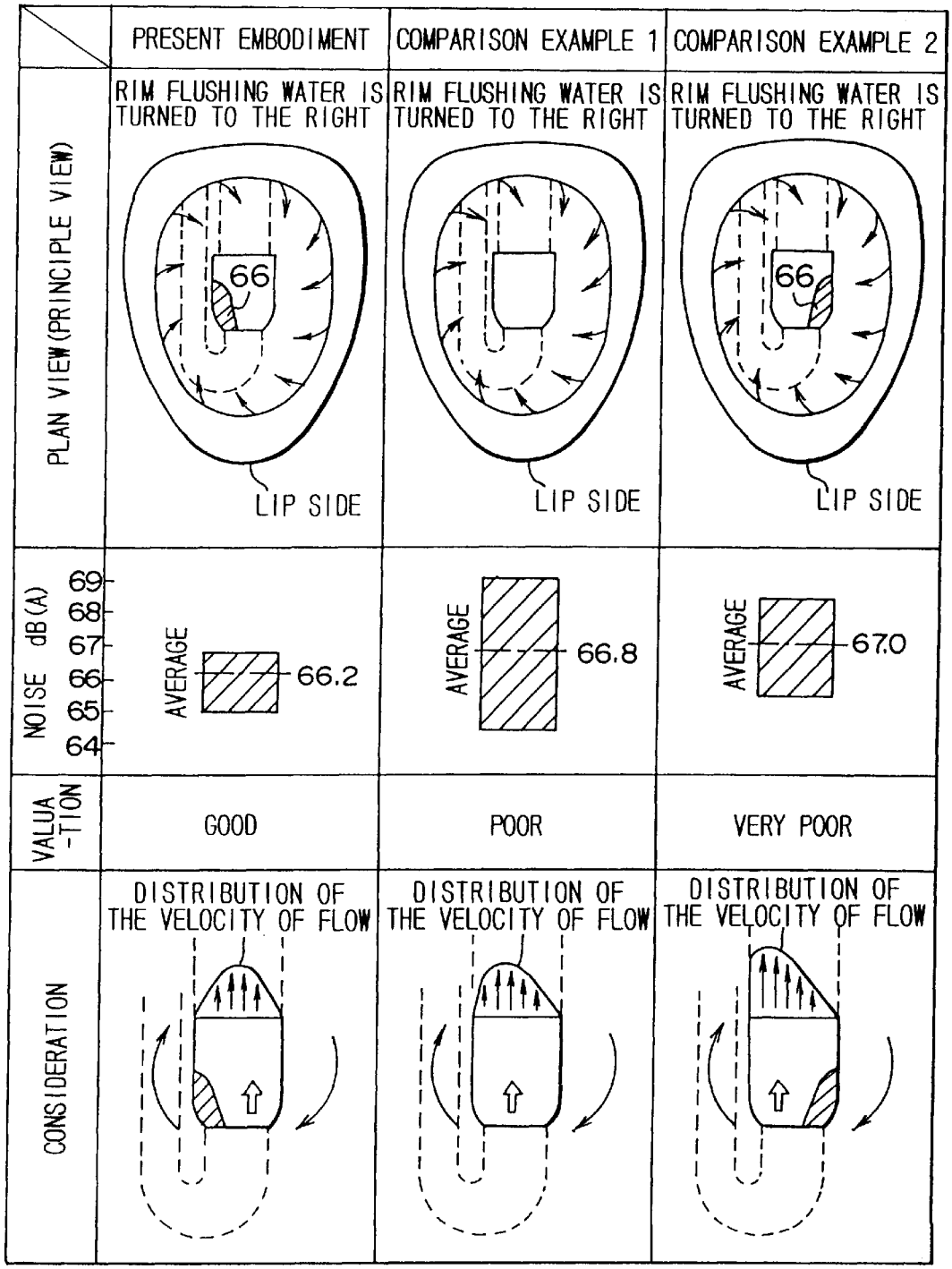
FIG. 24 is a diagram for comparison of the embodiment according to the invention with a comparison example.

FIG. 24 is a diagram for comparison of the present embodiment with comparison examples. It is shown by the plan views (principle views) for convenience, the first view in which, in the case of the rim flushing water being turned to the right, the offset block 66 exists at the left side as viewed from the lip side (i.e., the direction of offset is right) showing the present embodiment, the second view in which no offset block exists (i.e., no offset) showing the comparison example 1, and the third view in which the offset block 66 exists at the right side (i.e., the direction of offset is left) showing the comparison example 2).

First, as for the noise test, in the present embodiment, the flushing noise including the syphon breaking-off noise is 65.0 to 66.8 dB(A), and 66.2 dB(A) on the average.

The point of measurement is a place spaced by 1.0 m upwardly from the rim surface of the toilet bowl and by 1.0 m forwardly from the fitting hole of the toilet bowl (going beyond the lip). The average is obtained by taking the five measurements under the same conditions and simply averaging these measurements.

In the comparison example 1, the flushing noise amounts to 64.3 to 69.0 dB(A), and 66.8 dB(A) on the average, and in the comparison example 2, the flushing noise amounts to 65.6 to 68.4 dB(A), and 67.0 dB(A) on the average.

Valuating the test result by the average value, the present embodiment is good, the comparison example 1 poor and the comparison example 2 very poor.

Considering the above-described valuation, it is thought that, in the comparison example 1, the peak of a distribution of the velocity of flow of the jet water is deflected to the left from the center because of the flow of rotation directed to the right in the rim, so that air is drawn from the right end portion where the velocity of flow is minute, thus making the flushing noise louder.

In the comparison example 2, it is thought that because the direction of offset is reverse, the peak of a distribution of the velocity of flow is largely deflected to the left, thus making the noise of the flow of water louder.

In the present embodiment, making the flow of water offset to the right causes the peak of a distribution of the velocity of flow to return to the center, thereby allowing the flushing noise to be lowered.

Figure 25:
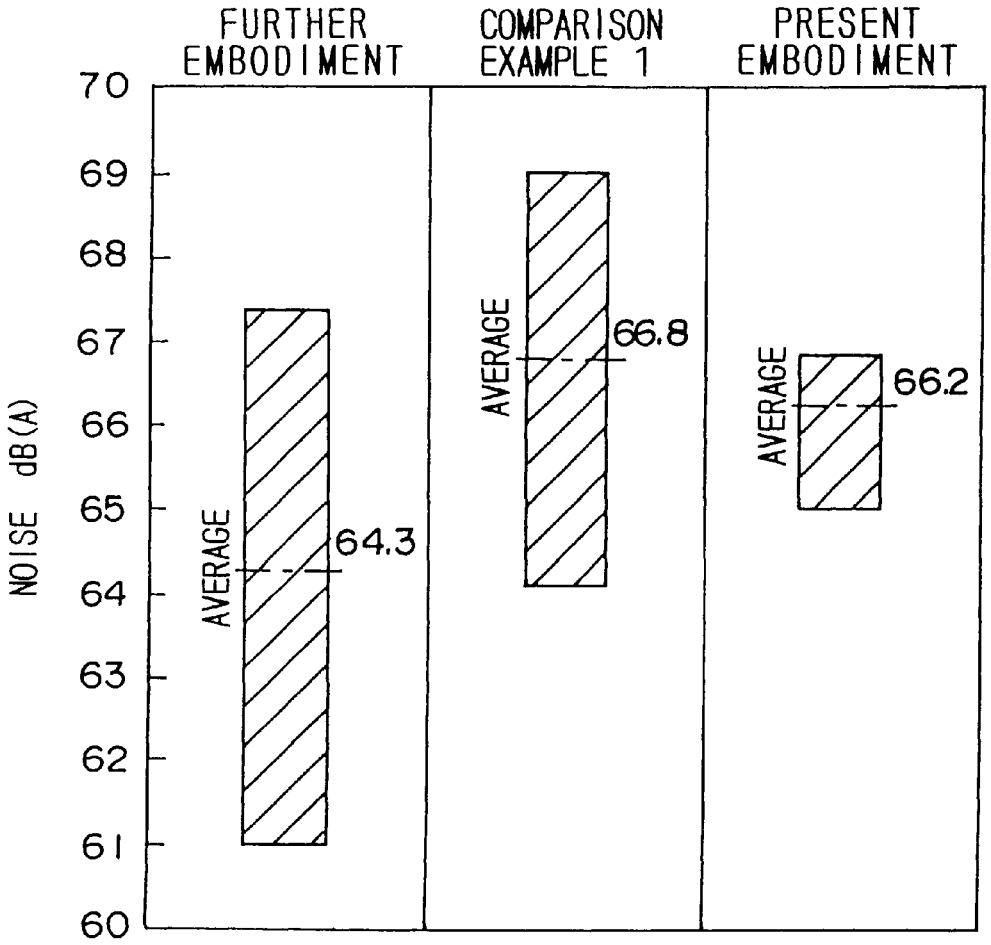
FIG. 25 is a view for comparison of a further embodiment according to the invention with a comparison example.

FIG. 25 is a graph for comparison of a new further embodiment with another example.

In the further embodiment, the rim delivery holes having larger diameters and the offset block 66 are properly arranged, i.e., the rim water outlet holes 32, 32' shown in FIG. 2 are combined with the above-described present embodiment.

In FIG. 25, the comparison example 1 and the present embodiment are those which are copied from the experimental results shown in FIG. 24 for comparison with the further embodiment.

According to the further embodiment, the multiplied effects due to both the improvement of the rotational characteristic of the flushing water delivered from the rim water outlet holes consisting of the large diameter rim water outlet holes 32, and the rationalization of a distribution of the velocity of flow due to the offset block, bring about the lower flushing noise of 61.0 to 67.4 dB(A), and 64.3 dB(A) on the average. Thus, the average value is greatly improved in comparison with the other examples and, therefore, the further embodiment is valuated as very good.

Figure 26:
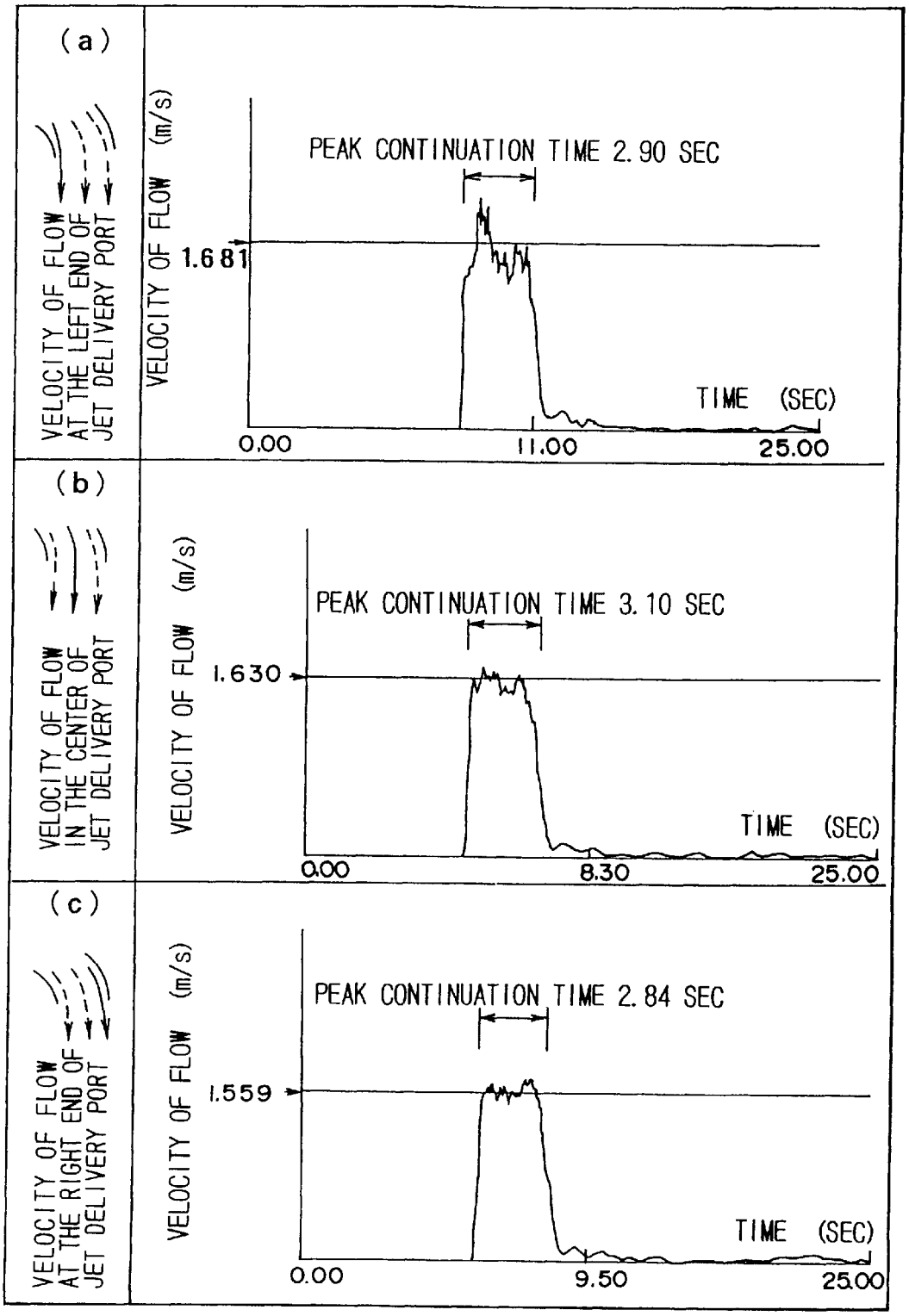
FIG. 26 is a view showing a relation between the flow velocities from the jet delivery port and the flow velocity characteristics, (a) showing a relation to the flow velocity at the left end of the jet delivery port, (b) showing a relation to the flow velocity in the center of the jet delivery port and (c) showing a relation to the flow velocity at the right end of the jet delivery port.
Figure 27:
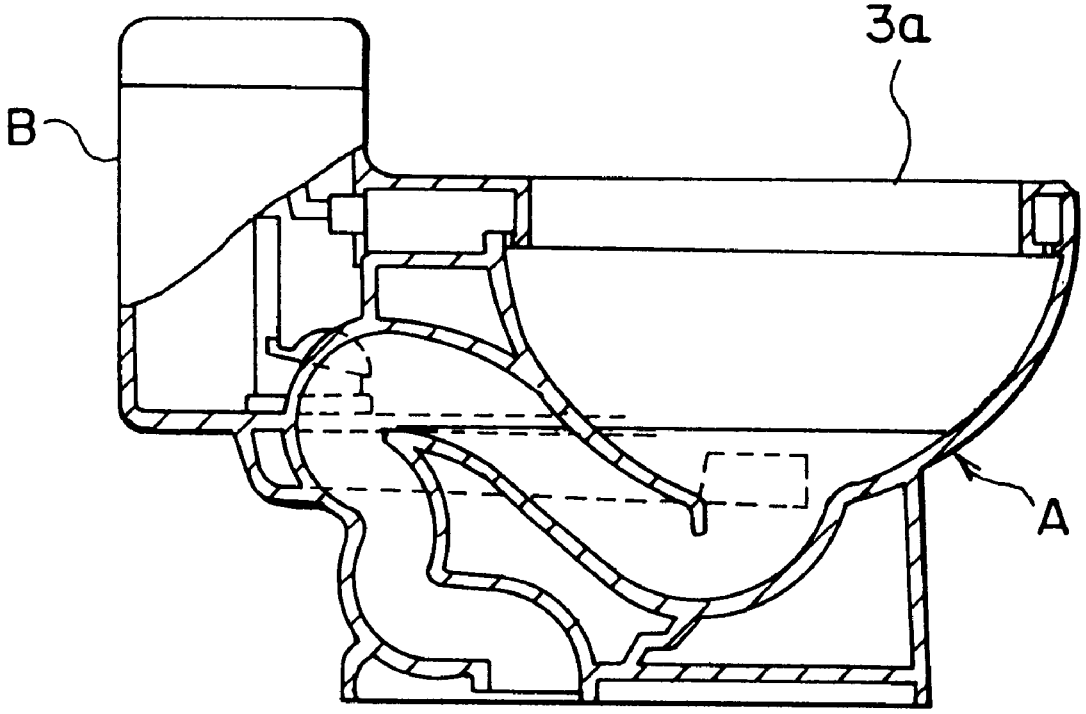
FIG. 27 is a central longitudinal sectional view showing an example of a flush toilet bowl in the prior art.

Further, in the embodiments shown in FIGS. 1 to 4, the velocity of flow from the jet delivery port is measured in the three divided regions of the right, center and left, and the characteristic of the velocity of flow shown in FIG. 26 is obtained. The comparison of FIG. 26 with FIG. 15 shows that particularly referring to FIG. 26(*a*), the velocity of flow from the jet delivery port reaches the peak approximately in 0.3 seconds after the discharge valve of the tank is opened, and the potential energy obtained from the tank is consumed approximately in 0.1 second. However, it is thought that since the syphoning action is already produced, the tractive force accompanied by the production of the syphoning action maintains the velocity of flow near the jet delivery port for a period of time of 1.5 seconds and more. In the case where FIG. 26 and FIG. 15 are compared, it is necessary for comparison to superimpose them, with the points, when the wavelike lines rise, as their reference points. Further, although, in FIG. 26(*a*), (b) and (c), the respective axes of time do not correspond to each other, this results from the fact that each synchronization is not taken when the wave-like line is recorded. Therefore, the absolute values of the axis of time (for example, 11.00, 25.00 in (a)) are not the particularly significant numerical values. This also applies to the case in FIG. 15.

Applying the tractive force due to the syphoning action to the flow of jet delivery water, causes the flow from the jet water delivery port to be continued for a longer period of time, thereby allowing the minute sewage and the like to be surely discharged.

The present invention provides a flush toilet bowl which allows the production of a syphoning action within the discharge trap to be promoted and also allows the large flushing capacity to be displayed with a small amount of flushing water.

Further, the present invention provides a flush toilet bowl which allows the large flushing capacity to be displayed with a small amount of flushing water by effectively producing a jet flow from the jet water delivery port and causing the production of a syphoning action within the discharge trap more surely.

The present invention offers particularly superior effects when it is applied to a low-silhouette type flush toilet bowl which is relatively low at the position where the flush water tank is installed.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

We claim:

1. A flush toilet bowl comprising:

a bowl part;

a discharge trap formed continuously at a bottom of said bowl part, said discharge trap including a rising channel extending in an obliquely upward direction from the bottom of the bowl part;

a first weir formed at an upper end of said rising channel;

a descending channel extending downwardly from said first weir; and a cross-laid channel extending substantially horizontally from a lower end of said descending channel and having a discharge opening at an end thereof;

said cross-channel is provided with an upwardly bent second weir between the lower end of said descending channel and the discharge opening, said cross-laid channel is formed with a gathered water part between said second weir and the lower end of said descending channel; and said descending channel is formed in a vicinity of a lower end thereof with a horizontal part extending horizontally toward said cross-laid channel, said horizontal part is above said gathered water part.

2. A flush toilet bowl as claimed in claim 1, wherein a ventilation space is formed between an upper wall of the cross-laid channel and the surface of the gathered water in said gathered water part, and said horizontal part is positioned in a range of said ventilation space.

3. A flush toilet bowl as claimed in claim 2, wherein the horizontal part is provided substantially at the level of ⅔ the distance from said surface of the gathered water to said ventilation space.

4. A flush toilet bowl as claimed in claim 1, wherein the first weir is formed having a radius of curvature which is 0.9 to 1.4 times as large as a diameter of the discharge trap.

5. A flush toilet bowl as claimed in claim 1, wherein the descending channel of the discharge trap is substantially in the form of a cylinder with a diameter of 100 to 150 mm and extends substantially in a vertically downward direction from the first weir.

6. A flush toilet bowl as claimed in claim 1, wherein the second weir and the discharge opening of the cross-laid channel continue by way of a downward bent part, and said downward bent part is formed having a radius of curvature which is 0.7 to 1.2 times as large as a diameter of the discharge trap.

7. A flush toilet bowl as claimed in claim 1, wherein the discharge trap has a substantially identical cross sectional area from an inlet thereof to the discharge opening of the cross-laid channel.

8. A flush toilet bowl comprising:

a toilet bowl body having a bowl part and a discharge trap formed continuously at a bottom of said bowl part;

a flush water tank disposed at a back of said toilet bowl body, a discharge port of said flush water tank is positioned substantially at the same level as a rim surface of the toilet bowl body;

a jet water path connecting the discharge port of said flush water tank to a jet water delivery port provided facing an inlet of said discharge trap; and said jet water path having a bent part turning the direction of flow toward the jet water delivery port before the jet water delivery port, and said jet water delivery port is provided in a vicinity thereof with a means for revising a distribution of the velocity of flow, said means performing the revision of the distribution of the velocity of flow so that the velocity of flow becomes substantially uniform.

9. A flush toilet bowl as claimed in claim 8, wherein the means for revising the distribution of the velocity of flow includes a construction of the axis of said jet water delivery port being offset to an inner peripheral side of said bent part.

10. A flush toilet bowl as claimed in claim 8, wherein the means for revising the distribution of the velocity of flow comprises an inclined surface formed by tilting a bottom of the bent part of the jet water path toward an inner peripheral side.

11. A flush toilet bowl as claimed in claim 8, wherein the bent part of the jet water path is formed having a radius of curvature of 20 to 30 mm.

12. A flush toilet bowl as claimed in claim 8, wherein the jet water path has a cross-sectional area of 0.3 to 0.6 times a cross-sectional area of the discharge trap.

13. A flush toilet bowl as claimed in claim 8, wherein the flush water tank is formed so that it has a water level of 100 to 120 mm and a diameter of the discharge port is 70 to 75 mm.

14. A flush toilet bowl comprising:

a toilet bowl body having a bowl part and a discharge trap formed continuously at a bottom of said bowl part;

a flush water tank disposed at a back of said toilet bowl body, a discharge port of said flush water tank is positioned substantially at the same level as a rim surface of the toilet bowl body;

a jet water path connecting the discharge port of said flush water tank to a jet water delivery port provided facing an inlet of said discharge trap; and said jet water path is provided with an air discharging means by which the air within said jet water path is discharged substantially at the same time the discharge of water from the discharge port of said flush water tank is started.

15. A flush toilet bowl as claimed in claim 14, wherein the jet water path has a horizontal path passing around toward a front part of the toilet bowl body substantially in the horizontal situation in a position lower than a surface of gathered water in the toilet bowl body.

16. A flush toilet bowl as claimed in claim 14, wherein the jet water path has an inclined descending path inclined in an obliquely downward direction, said inclined descending path is provided in a vicinity of a lower end thereof with a portion for abruptly changing a direction of flow of flushing water.

17. A flush toilet bowl as claimed in claim 14, wherein the flush water tank is formed having a water level of 100 to 120 mm and a diameter of the discharge port is 70 to 75 mm.

18. A flush toilet bowl comprising:

a bowl part;

a discharge trap formed continuously at a bottom of said bowl part, said discharge trap including:

a rising channel extending in an obliquely upward direction from the bottom of the bowl part;

a first weir formed at an upper end of said rising channel;

a descending channel extending downwardly from said first weir; and a cross-laid channel extending substantially horizontally from a lower end of said descending channel and having a discharge opening at an end thereof;

said cross-laid channel is provided with an upwardly bent second weir between the lower end of said descending channel and the discharge opening, said cross-laid channel is formed with a gathered water part between said second weir and the lower end of said descending channel;

said descending channel is formed in a vicinity of a lower end thereof with a horizontal part extending horizontally toward said cross-laid channel; and a ventilation space is formed between an upper wall of the cross-laid channel and the surface of the gathered water in said gathered water part, and said horizontal part is positioned in a range of said ventilation space.

19. A flush toilet bowl as claimed in claim 18, wherein the horizontal part is provided substantially at the level of ⅔ the distance from said surface of the gathered water to said ventilation.

* * * * *